US006651980B2

(12) United States Patent
Isemura et al.

(10) Patent No.: US 6,651,980 B2
(45) Date of Patent: Nov. 25, 2003

(54) SHEET CONVEYING APPARATUS WITH CORRECTION DEVICE TO COMPENSATE FOR SHEET INTERVAL VARIATION

(75) Inventors: Keizo Isemura, Tokyo (JP); Ikuo Takeuchi, Ibaraki (JP); Shinsuke Ubayashi, Chiba (JP); Ichiro Sasaki, Ibaraki (JP); Manabu Yamauchi, Chiba (JP); Takashi Nakanishi, Chiba (JP); Tomoyasu Yoshikawa, Ibaraki (JP); Kenji Fukushi, Ibaraki (JP); Hiroto Nishihara, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/160,116

(22) Filed: Jun. 4, 2002

(65) Prior Publication Data

US 2003/0038418 A1 Feb. 27, 2003

(30) Foreign Application Priority Data

Jun. 13, 2001 (JP) ..... 2001-179020
Jun. 13, 2001 (JP) ..... 2001-179021
Jun. 13, 2001 (JP) ..... 2001-179024

(51) Int. Cl.[7] ..... B65H 7/02

(52) U.S. Cl. ..... 271/259; 271/258.01; 271/265.01; 271/265.02; 271/265.03; 271/266

(58) Field of Search ..... 271/258.01, 259, 271/265.01, 265.02, 265.03, 266

(56) References Cited

U.S. PATENT DOCUMENTS 4,451,027 A * 5/1984 Alper ..... 271/10.02
5,056,771 A * 10/1991 Beck et al. ..... 271/114
5,221,949 A * 6/1993 Miyamoto ..... 399/389
5,423,527 A * 6/1995 Tranquilla ..... 271/10.02
5,461,468 A * 10/1995 Dempsey et al. ..... 399/396
5,478,066 A 12/1995 Yoshida et al. ..... 271/12
5,484,141 A * 1/1996 Yamashita et al. ..... 271/227
5,575,466 A * 11/1996 Tranquilla ..... 271/10.03
5,689,759 A 11/1997 Isemura et al. ..... 399/45
5,692,741 A * 12/1997 Nakamura et al. ..... 271/10.03
5,692,742 A * 12/1997 Tranquilla ..... 271/10.03
5,815,786 A 9/1998 Isemura ..... 399/376
6,023,034 A * 2/2000 Nakajima et al. ..... 209/584
6,076,821 A * 6/2000 Embry et al. ..... 271/10.01
6,126,160 A * 10/2000 Ebert et al. ..... 271/10.03
6,126,345 A * 10/2000 Ito et al. ..... 400/624
6,330,422 B1 12/2001 Sato et al. ..... 399/382

FOREIGN PATENT DOCUMENTS

JP 05319630 A * 12/1993 ..... B65H/9/00

* cited by examiner

*Primary Examiner*—Donald P. Walsh
*Assistant Examiner*—Matthew J. Kohner
(74) *Attorney, Agent, or Firm*—Fitzpatrick, Cella, Harper & Scinto

(57) ABSTRACT

A sheet conveying apparatus permits keeping predetermined sheet intervals, even when sheet conveyance is temporarily discontinued and then resumed, after resumption of conveyance. The sheet conveying apparatus has a first roller which feeds sheets at predetermined sheet intervals, and a second roller which conveys a plurality of sheet fed from the first roller. After temporarily discontinuing conveyance of the plurality of sheets, conveyance of the plurality of sheets is resumed by use of the first roller and the second roller. The variation in the sheet interval caused when temporarily discontinuing sheet conveyance is corrected upon resumption of sheet conveyance.

21 Claims, 21 Drawing Sheets

FIG. 22

SERVICE 1

MEASURE CLUTCH ADJUSTMENT VALUE START

MEASURING/MEASUREMENT FINISHED

FIG. 23

SERVICE 2

MEASURE CLUTCH ADJUSTMENT VALUE START

| | | | |
|---|---|---|---|
| CL 1: | 00 | CL 6: | 00 |
| CL 2: | 00 | CL 7: | 00 |
| CL 3: | 00 | CL 8: | 00 |
| CL 4: | 00 | CL 9: | 00 |
| CL 5: | 00 | CL10: | 00 |

SHEET CONVEYING APPARATUS WITH CORRECTION DEVICE TO COMPENSATE FOR SHEET INTERVAL VARIATION

BACKGROUND OF THE INVENTION

1. Field of the Invention

The present invention relates to a sheet conveying apparatus conveying sheets.

2. Description of the Related Art

A conventional electrophotographic type copying machine has a configuration in which, when a registration roller provided immediately upstream of a photosensitive drum is stopped, skewing of sheets is corrected by causing a fed sheet to hit a the nip of the registration rollers. In a copying machine having a long conveying path from the feeder to the photosensitive drum, following sheets are sequentially fed without waiting for image forming on the preceding sheet by the photosensitive drum, to improve productivity of the copying machine. As a result, there exist a plurality of sheets on the conveying path from the feeder to the photosensitive drum.

During the time skewing of the sheet is corrected, the sheet is substantially stopped in position at the registration rollers. To prevent the following sheet from catching up the preceding sheet, therefore, the following sheet is also temporarily stopped in dependence thereon. Then, the roller immediately upstream of the photosensitive drum and the rollers from the feeder to the photosensitive drum are simultaneously driven, and feeding of a plurality of sheets on the conveying path is resumed.

There is at present a demand for further improvement of productivity of the conventional copying machine as described above, and for this purpose, it is necessary to further reduce the sheet interval. However, a sheet interval shorter than the conventional one poses a problem of a shift of the sheet stopping position. A roller for feeding sheets is driven by a DC motor via a clutch, which is released when causing the sheet to temporarily stop. When the clutch is released, the roller stops as a result of the effect of friction of the bearing of the roller. Because the roller is stopped through bearing friction, the roller slightly rotates during the period from clutch release to roller stoppage, and the following sheet held by the roller approaches the preceding sheet that is in contact with the registration roller. Feeding of all the sheets in temporary stoppage on the conveying path is resumed at a time. The sheets are often fed therefore with a very short distance between the trailing edge of the preceding sheet and the leading end of the following sheet, thus resulting in an abnormality in conveyance control of the sheets. The stoppage characteristics of the roller might be different from the one of the other roller because of the individual difference. Also, the stoppage characteristics of the roller might be changed because of the secular change.

SUMMARY OF THE INVENTION

Accordingly, it is an object of the present invention to provide a sheet conveying apparatus solving the above-mentioned problems.

The present invention provides a sheet conveying apparatus comprising a sheet feeder which feeds sheets at predetermined sheet intervals; a conveyor which conveys a plurality of sheets fed by the sheet feeder; a controller which, after temporarily discontinuing conveyance of the plurality of sheets by the conveyor, resumes conveyance of the plurality of sheets by the conveyor; and a corrector which corrects, upon resuming sheet conveyance, variations in the sheet interval caused upon temporarily discontinuing sheet conveyance.

In the sheet conveying apparatus of the invention, the corrector delays the resumption of conveyance of a following sheet by a time corresponding to a decrease in the sheet interval which is caused upon temporary discontinuance of sheet conveyance.

The invention also provides a sheet conveying apparatus comprising a feeder which feeds first, second and third sheets at predetermined intervals; a conveyor which conveys the first, second and third sheets fed by the feeder to a registration roller; a controller which, after temporarily discontinuing conveyance of the first, second and third sheets by the conveyor in response to arrival of the first sheet at the registration roller, resumes conveyance of the first, second and third sheets by the conveyor; and a corrector which corrects a variation in the sheet interval between the first sheet and the second sheet upon resuming conveyance of the second sheet, and corrects a variation in the sheet interval between the second sheet and the third sheet upon resuming conveyance of the third sheet.

The aforementioned corrector, in the aforementioned sheet conveying apparatus, resumes conveyance of the second sheet by delaying by a first period of time corresponding to the sheet interval between the first and second sheets which is decreased upon temporary discontinuance of sheet conveyance, and resume conveyance of the third sheet by delaying by a second period of time corresponding to the sheet interval between the second and third sheets which is decreased upon temporary discontinuance of sheet conveyance.

In another respect, the invention provides a sheet conveying apparatus comprising a roller which conveys sheets; a driver which generates a driving force to drive the roller; a clutch which transmits a driving force of the driver to the roller; a controller which controls engagement and disengagement of the clutch; and a memory which stores data of stop characteristics of the roller upon disengagement of the clutch; wherein the controller controls a connecting timing of the clutch on the basis of the data stored in the memory.

The aforementioned controller delays the reengagement of the clutch by a period of time corresponding to the data stored in the memory.

The aforementioned controller controls engagement of the clutch after causing disengagement of the clutch; and when the time from causing disengagement of the clutch to causing engagement of the clutch is shorter than the period of time corresponding to the data stored in the memory, the controller delays the engagement of the clutch by a period of time.

The data of stop characteristics of the roller stored in the memory are data corresponding to an amount of lead of a sheet conveyed by the roller upon disengagement of the clutch.

In the above-mentioned sheet conveying apparatus, data corresponding to an amount of lead of the sheet conveyed by the roller upon disengagement of the clutch based on a time required for conveying a sheet from a first position to a second position without disengaging the clutch, and a time required for conveying a sheet from the first position to the second position when the clutch is reengaged after disengaging the clutch when the sheet is present between the first position and the second position.

The invention provides also a sheet conveying apparatus comprising first, second and third rollers which convey sheets; a driver which generates a driving force to drive the first, second and third rollers; first, second and third clutches which transmit a driving force of the drive to the first, second and third rollers; a controller which controls engagement and disengagement of the first, second and third clutches; and a memory which stores first data of stop characteristics of a sheet upon disengagement of the first and second clutches while the first and second rollers hold the sheet in between, and second data of stop characteristics of the sheet upon disengagement of the second and third clutches while the second and third rollers hold the sheet in between; wherein the controller controls the engagement timing of the first, second and third clutches on the basis of any of the first and second data stored in the memory.

The first and second data stored in the memory comprise data corresponding to an amount of lead of the sheet conveyed by the first and second rollers upon disengagement of the first and second clutches, and data corresponding to an amount of lead of the sheet conveyed by the second and third rollers upon disengagement of the second and third clutches.

The controller selects one of the first and second data, depending upon by which of the first, second and third rollers the sheet is held in between.

The aforementioned controller selects the first data when the sheet is held by the first and second rollers in between, not by the third roller in between, and selects the second data when the sheet is held by the second and third rollers in between, not by the first roller.

The aforementioned controller selects the first data if the sheet is held by the first, second and third rollers in between when the first data show stop characteristics for stoppage of the sheet within a shorter period of time than the second data.

The aforementioned controller selects the second data if the sheet is held by the first, second and third rollers in between when the second data show stop characteristics for stoppage of the sheet within a shorter period of time than the first data.

The present invention provides a sheet conveying apparatus comprising a conveyor which conveys sheets along a conveying path; a controller which, after temporarily discontinuing sheet conveyance during conveyance of the sheet by the conveyor, resumes sheet conveyance; a first sensor provided on the conveying path; a second sensor provided in the downstream of the first sensor on the conveying path; and a measurer which causes the conveyor to convey the sheet, causes sheet conveyance to stop when a sheet is between the first sensor and the second sensor; resumes sheet conveyance after the lapse of a predetermined period of time; and measures a first period of time from detection of an edge of the sheet by the first sensor to detection of an edge of the sheet by the second sensor.

The conveyor contains a first roller which conveys sheets; the first sensor is provided upstream of the first roller, and the second sensor is provided downstream of the first roller.

The aforementioned controller controls the timing for resuming conveyance in response to the result of measurement by the measurer.

The above-mentioned sheet conveying apparatus further comprises a third sensor provided downstream of the second sensor in the conveying path; wherein the measurer causes the sheet having temporarily stopped between the first sensor and the second sensor to stop between the second sensor and the third sensor; resumes sheet conveyance after the lapse of a predetermined period of time; and measures a second period of time from detection of an end of the sheet by the second sensor to detection of an end of the sheet by the third sensor.

The conveyor contains a first roller and a second roller; the first sensor is provided upstream of the first roller; the second sensor is provided between the first roller and the second roller; and the third sensor is provided downstream of the second roller.

The above-mentioned controller controls the timing for resuming conveyance in response to any of the first period of time and the second period of time.

The aforementioned sheet conveying apparatus further comprises a terminal for entering an instruction to start a measuring mode for measuring characteristics of the conveyor during stoppage of conveyance and upon resumption of conveyance by the conveyor; wherein measurement is started in response to input of the instruction to start the measuring mode from the terminal.

Further objects, features and advantages of the present invention will become apparent from the following description of the preferred embodiments with reference to the attached drawings.

BRIEF DESCRIPTION OF THE DRAWINGS

FIG. 22 illustrates a clutch adjustment value measuring screen in service mode.

FIG. 23 illustrates a clutch adjustment value measuring screen in service mode.

DESCRIPTION OF THE PREFERRED EMBODIMENTS

Figure 1:
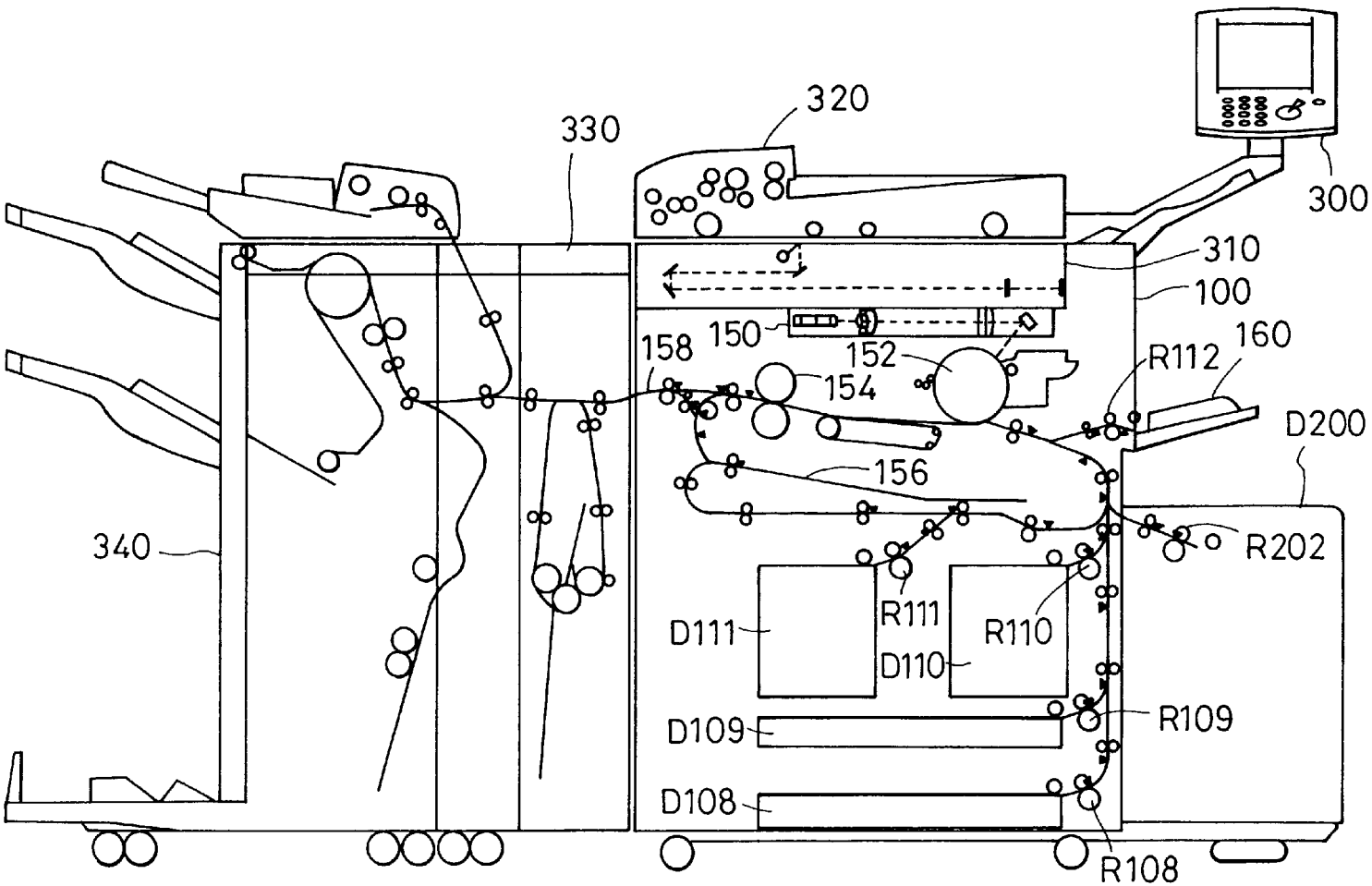
FIG. 1 illustrates the image forming apparatus of an embodiment of the present invention.

FIG. 1 illustrates the image forming apparatus of an embodiment of the present invention. The image forming apparatus of this embodiment comprises a printer 100, an optional paper feeding deck D200, an operator unit 300, a scanner 310, an original feeder 320, a sheet folder 330, and finisher 340. The printer 100 forms an original image read in by the scanner 310 by an electrophotographic method or an image received via a network on a sheet. The original feeder 320 automatically feeds the original to a reading position of the scanner 310. The optional paper feeding deck D200 has a large-capacity sheet loader, and is attached to the printer 100 as required. The operator unit 300 takes inputs of settings of the image forming apparatus and displays the status of the image forming apparatus. The sheet folder 330 Z-folds A3-sized sheets. When folding is not set in the operator unit 300, the sheet is not folded, but fed to the finisher 340 in the downstream. The finisher 340 serves as a paper discharge port having a plurality of paper discharge trays, and as a sheet finisher carrying out sheet binding and the like. The finisher 340 discharges the sheet conveyed from the upstream side onto the paper discharge tray.

In the printer 100, a laser beam emitter 150 emits a laser beam in response to an image from the scanner 310 or an image received via a network. The emitted laser beam is irradiated onto the photosensitive drum 152, and a latent image is thus formed on the photosensitive drum 152. The photosensitive drum 152 is developed with toner, and the resultant toner image is transferred onto the fed sheet. The toner transferred onto the sheet is fixed onto the sheet by a fixing roller 154. The sheet having passed through the fixing roller 154 is sent to the sheet folder 330 on the downstream side via a discharge path 158, or surface-back-reversed via a two-side path 156 and sent again to the photosensitive drum 152.

The printer 100 can feed sheets from paper feeding cassettes D108 and D109, paper feeding decks D110 and D111, and a manual paper feeder 160, as well as from an optional paper feeding deck D200.

Figure 2:
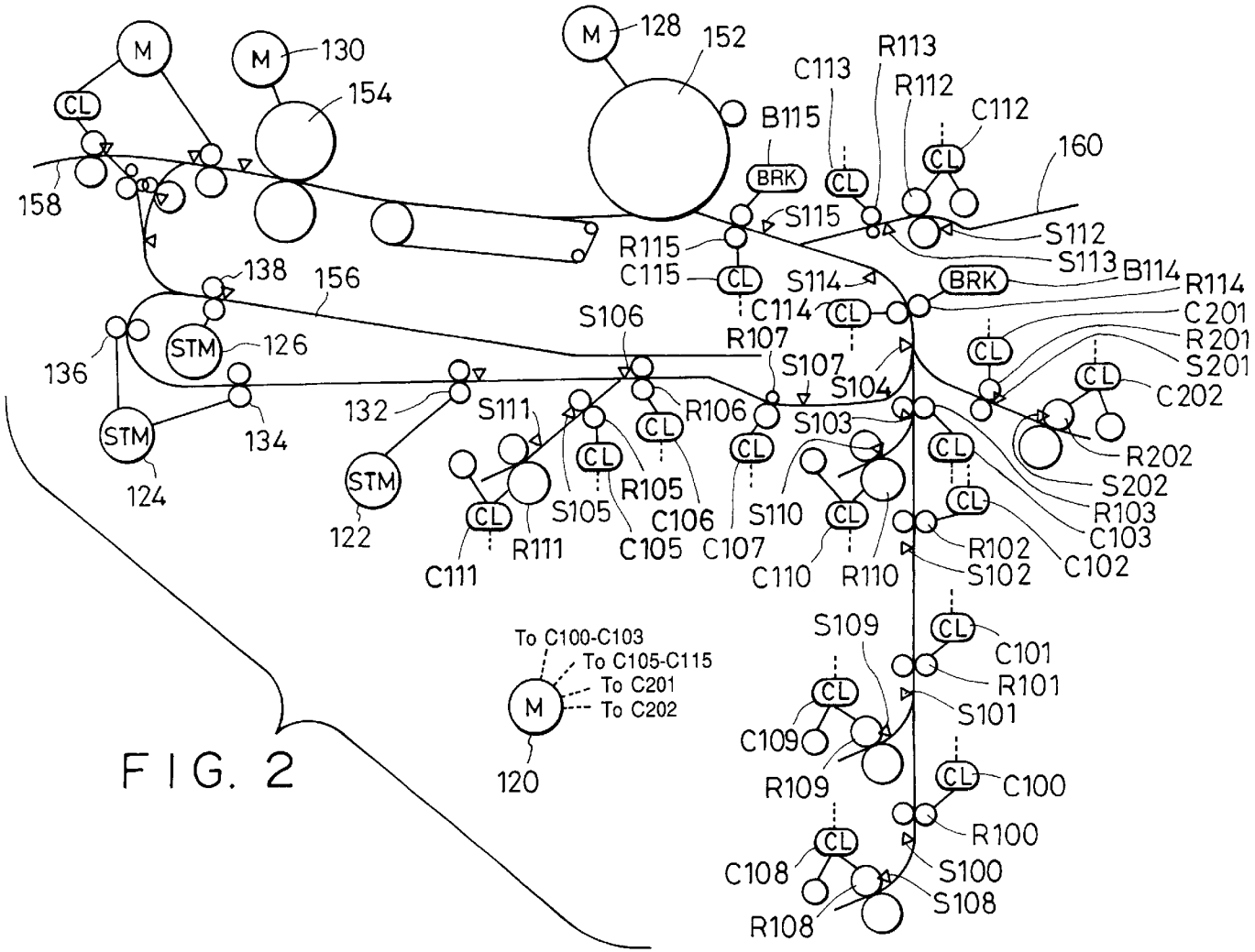
FIG. 2 illustrates a configuration of a sheet conveyance in a printer 100.

FIG. 2 illustrates a configuration for sheet conveyance in the printer 100. Sheets loaded onto the paper feeding cassette D108 are picked up by a roller R108. The top sheet is separated conveyed to the photosensitive drum 152 by rollers R100, R101, R102, R103, R114 and R115. Similarly, the sheet delivered from the paper feeding cassette D109 by the roller R109 is conveyed to the photosensitive drum 152 by the rollers R101, R102, R103, R114 and R115. The sheet delivered from the paper feeding deck D110 by the roller R110 is conveyed to the photosensitive drum 152 by the rollers R103, R114 and R115. The sheet delivered from the paper feeding deck D111 by the roller R111 is conveyed to the photosensitive drum 152 by the rollers R105, R106, R107, R114 and R115. The sheet delivered from the manual paper feeder 160 by the roller R112 is conveyed to the photosensitive drum 152 by the rollers R113 and R115. The sheet delivered from the optional paper feeding deck D200 by the roller R202 is conveyed to the photosensitive drum 152 by the rollers R201, R114 and R115.

The sheet fed from the paper feeders such as the paper feeding cassettes D108 and D109, the paper feeding decks D110 and D111, the manual paper feeder 160, the optional paper feeding deck D200 and the two-sided pass 156 may skew. Sheet skewing is therefore corrected by causing the sheet to hit a pair of registration rollers R115 in a state in which the registration rollers R115 are stopped. To improve productivity of the image forming apparatus, the following sheets are sequentially fed without waiting for image forming of the preceding sheet by the photosensitive drum 152. As a result, a plurality of sheets are present in the conveying path from the feeders to the photosensitive drum 152. Since the sheet having hit the registration rollers R115 is substantially in stoppage, the following sheets are accordingly once stopped so that the following sheet does not catch up to the preceding sheet.

The rollers R100 to R103, R105 to R115, R201 and R202 are driven by a motor 120 via respective clutches C100 to C103, C105 to C115, C201 and C202. The motor 120 is a DC motor. A driving force of the motor 120 is transmitted to the rollers through connection of the clutches, and transmission of the driving force of the motor 120 is discontinued by clutch release.

The rollers R114 and R115 have respective electromagnetic brakes B114 and B115. By turning on the electromagnetic brakes B114 and B115 along with release of the clutches C114 and C115 corresponding to these rollers, it is possible to instantaneously stop the rollers R114 and R115.

No electromagnetic brake is provided in the rollers R100 to R103, R105 to R113, R201 and R202. Roller stoppage is therefore accomplished by clutch release alone. Because these rollers have no electromagnetic brake, it is possible to reduce the cost of the image forming apparatus. When the clutch is released, roller rotation is discontinued as a result of the effect of friction of the roller bearing and friction of the contact portion of the roller pair. Friction of the contact portion of the roller pair differs depending upon the roller material. The amount of roller rotation during the period from clutch release to roller stoppage, i.e., the amount of lead of the sheet up to stoppage of the sheet varies with the frictional force of the roller bearing, the mechanical structure of the roller, the roller material, differences between individual rollers and various other factors. In addition, when a single sheet is held by a plurality of kinds of roller, they exert influence on each other, and the amount of lead of the sheet from clutch release to sheet stoppage varies.

Table 1 shows kinds of roller bearings, the roller materials, the mechanical structure of roller driving, and the presence or absence of electromagnetic brakes. The rollers R100, R101, R105, R106, R113 and R201 are rubber rollers held by sintered bearings, with no electromagnetic brake. The rollers R102 and R103 are rubber rollers held by ball bearings, with no electromagnetic brake. The roller R107 is a sponge roller held by a ball bearing, with no electromagnetic brake. The roller R107 conveys sheets, and conducts curl removal. The rollers R108, R109, R110, R111, R112 and R202 are separating rollers made of rubber and have a mechanical structure in which one of the roller pair rotates in the feeding direction for sheet separation, and the other rotates in a direction reverse to the feeding direction.

The rollers R114 and R115 are rubber rollers held by sintered bearings, with electromagnetic brakes B114 and B115 provided thereon. The resist roller R115 should be stationary when the following sheets are fed at small sheet intervals arrive after sending the preceding sheet. There is therefore provided an electromagnetic brake capable of instantaneously stopping roller rotation after the trailing edge of the sheet leaves the roller. The roller R114 must be accurately stopped at the point in time when a prescribed amount of sheet has been fed after the sheet is brought into contact with the registration roller R115. The electromagnetic brake is provided after driving the roller for a prescribed period of time to instantaneously stop the roller rotation.

TABLE 1

| Roller reference | Bearing | Roller material | Mechanical structure | Electromagnetic brake |
|---|---|---|---|---|
| R100 | sintered | rubber | conveying mechanism | none |
| R101 | sintered | rubber | conveying mechanism | none |
| R102 | ball bearing | rubber | conveying mechanism | none |
| R103 | ball bearing | rubber | conveying mechanism | none |
| R105 | sintered | rubber | conveying mechanism | none |
| R106 | sintered | rubber | conveying mechanism | none |
| R107 | ball bearing | sponge | conveying mechanism | none |
| R108 | | rubber | separating mechanism | none |
| R109 | | rubber | separating mechanism | none |
| R110 | | rubber | separating mechanism | none |
| R111 | | rubber | separating mechanism | none |
| R112 | | rubber | separating mechanism | none |
| R113 | sintered | rubber | conveying mechanism | none |
| R114 | sintered | rubber | conveying mechanism | provided |
| R115 | sintered | rubber | conveying mechanism | provided |
| R201 | sintered | rubber | conveying mechanism | none |
| R202 | | rubber | separating mechanism | none |

For a roller not having an electromagnetic brake, roller rotation is discontinued by releasing the clutch. A rubber roller held by a bearing requires the most time from clutch release to rubber rotation stoppage, then comes a sponge roller held by a bearing, and then comes a rubber roller held by a sintered bearing. A separating roller having a separation mechanism achieves the shorter period before stoppage.

Sensors S100 to S115, S201 and S202 are provided near the rollers R100 to R103, R105 to R115, R201 and R202. Sensors S115 and S114 are provided upstream of the photosensitive drum 152. The sensor S115 is for adjusting the timing for discontinuing roller rotation at a point in time when a predetermined amount of sheet has been conveyed after butt contact of the sheet leading end with the nip of the registration roller R115. The sensor S114 is for adjusting the timing of forming a latent image on the photosensitive drum 152 by the laser beam emitter 150.

Figure 8:
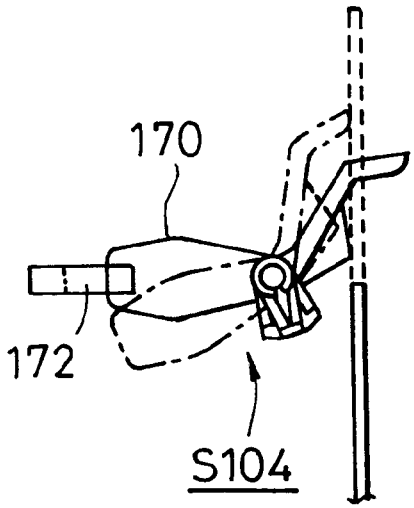
FIG. 8 illustrates a configuration of a flag sensor.

Each of the sensors S102, S106, S107, S104, S114, S115, S112 and S113 is a flag-type sensor comprising as shown in FIG. 8 a movable flag 170 and a beam emitter and a beam receiver 172 provided in a movable area of the flag. When a conveyed sheet passes on the sensor, the sheet knocks the flag 170 (movable member) alone. When the flag 170 shuts off the optical path of the beam emitter and the beam receiver 172, i.e., when the flag 170 is not knocked down by the sheet (when the flag 170 is at a first position), it is determined that the sheet is absent. When the flag 170 does not shut out the optical path of the emitter and the receiver 172, i.e., when the flag 170 is not knocked down by the sheet (when the flag is at a second position), the sheet is deemed to be present. By thus detecting whether or not the flag cuts off the optical path between the beam emitter and the beam receiver 172, the leading edge of the sheet and the presence or absence of the sheet is detected. The flag 170 is imparted a force by a spring so as to be in a state shown by a solid line. When the trailing edge of the sheet leaves the sensor, the flag 170 returns so as to block the optical path of the beam emitter and the beam receiver 172. The flag does not however return instantaneously, and a time lag is produced in the return thereof. It is therefore difficult to accurately detect the trailing edge of the sheet. The flag-type sensor is not suitable for accurate detection of the sheet as described above. Optical sensors are therefore used as the sensors S108, S100, S109, S101, S110, S102, S111 and S105 near the rollers R108, R109, R110 and R111, which detect the trailing edge of the preceding sheet upon feeding the sheet and create an accurate sheet interval.

Figure 9:
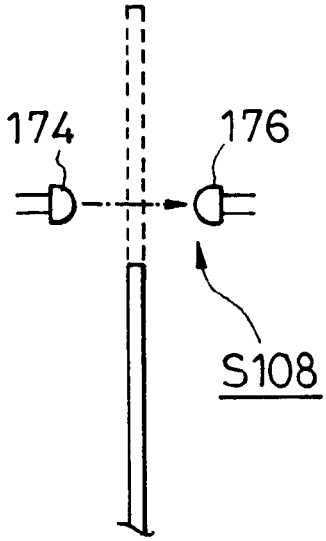
FIG. 9 illustrates a configuration of an optical sensor.

Each of the sensors S108, S100, S109, S101, S110, S102, S111 and S105 is an optical sensor comprising a light emitter 174 and a light receiver 176 as shown in FIG. 9. The leading and trailing edges of the sheet and the presence or absence of the sheet are detected by detecting whether or not the sheet cuts off the optical path between the light emitter 174 and the light receiver 176 when the conveyed sheet passes by the sensor.

The photosensitive drum 152 is driven by a motor 128, and the fixing roller 154 is driven by a motor 130. The sheet sent to the two-sided pass 156 is conveyed by the rollers 138, 136, 134 and 132. The roller 138 is driven by a motor 126; the rollers 136 and 134, by a motor 124; and the roller 132, by a motor 122. The motors 126, 124 and 122 are stepping motors. Positive and negative rotations of the motors are required, within the two-sided pass, for switching back the sheet. When receiving the sheet from the upstream side in the two-sided pass, it is necessary to rotate at a speed in response to that of the fixing roller, then to rotate at a higher speed so as to reduce the sheet interval, and to discontinue rotation at a prescribed position of the sheet. The stepping motor permitting each and accurate control of speed is therefore adopted.

Figure 3:
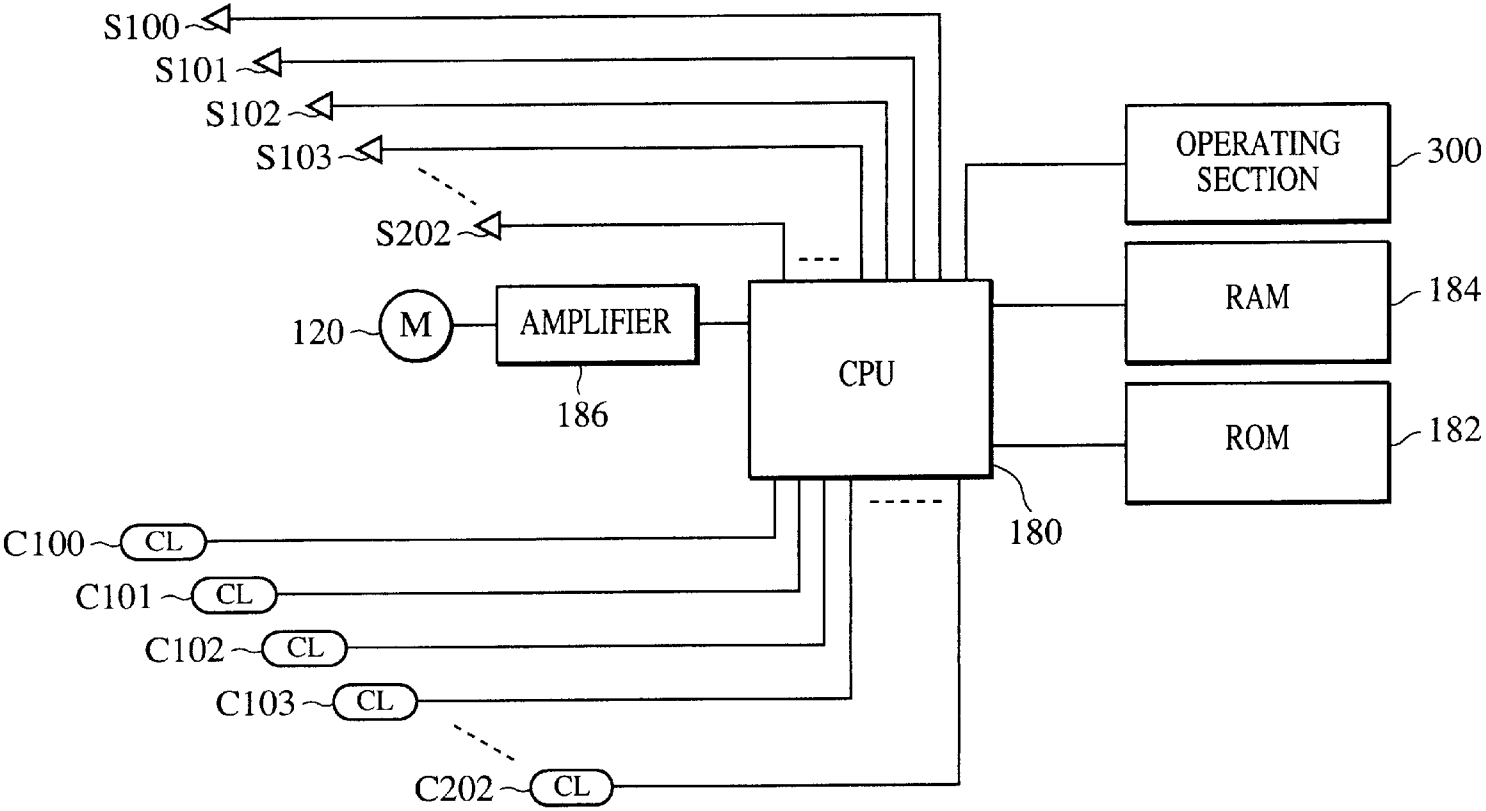
FIG. 3 is a block diagram illustrating the clutch control relationship.

FIG. 3 is a block diagram regarding clutch control. Output of the sensors S100 to S115, S201 and S202 is entered into a CPU 180. The CPU 180 controls driving of a motor 120 via an amplifier 186. Although not shown in FIG. 3, the CPU 180 also controls the driving of motors 128, 130, 122, 124 and 126. The CPU 180 controls connection and release of the clutches C100 to C103, C105 to C115, C201 and C202. Setting entered in the operator 300 is entered into the CPU 180, and the CPU causes the operator 300 to display a prescribed screen. A control program to be executed by the CPU 180 is stored in a ROM 182 readable by the CPU 180. Control programs described later are also stored in the ROM 182. Data necessary for the CPU 180 to perform control are written in a battery-backed-up RAM 184. Data measured for connection control described later are also written in the RAM 184. A non-volatile memory such as an EEPROM may be used in place of the RAM 184.

Figure 4:
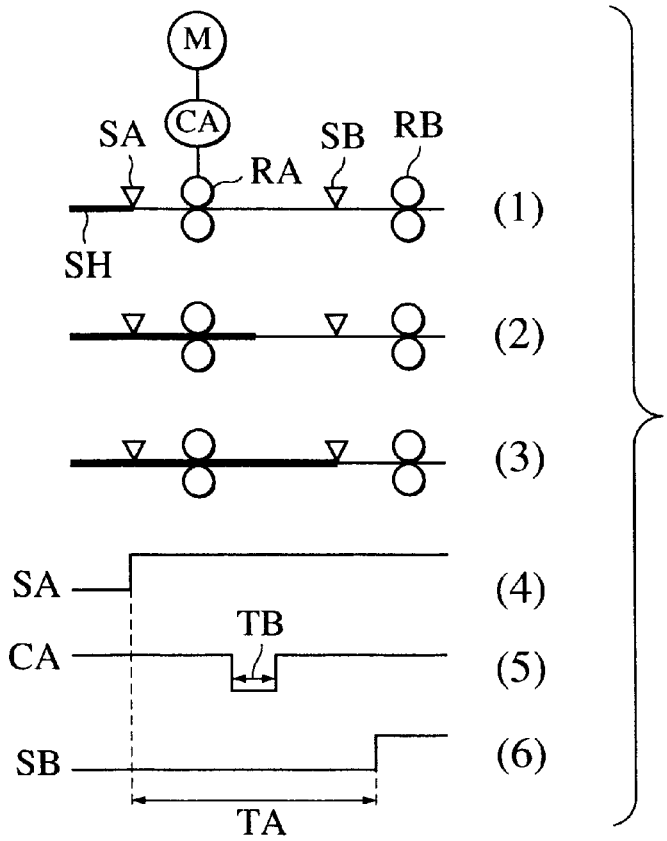
FIG. 4 illustrates a configuration for measuring roller properties when the clutch is connected after release.

In a configuration in which the rollers are driven via the clutches, the roller properties in the case where the clutch is connected after release of the clutch will now be described with reference to FIGS. 4 and 5. FIG. 4 illustrates a typical configuration in which the rollers are driven via the clutches. FIGS. 4(1) to 4(3) illustrate conveyance of a sheet SH. FIGS. 4(4) to 4(6) are timing charts for the sensor SA, the clutch CA and the sensor SB, respectively. A roller RA is driven by a motor M via a clutch CA. A roller RB is provided in the downstream of the roller RA. Sensors SA and SB are provided in the upstream of the rollers RA and RB, respectively. The roller RA has no electromagnetic brake.

Figure 5:
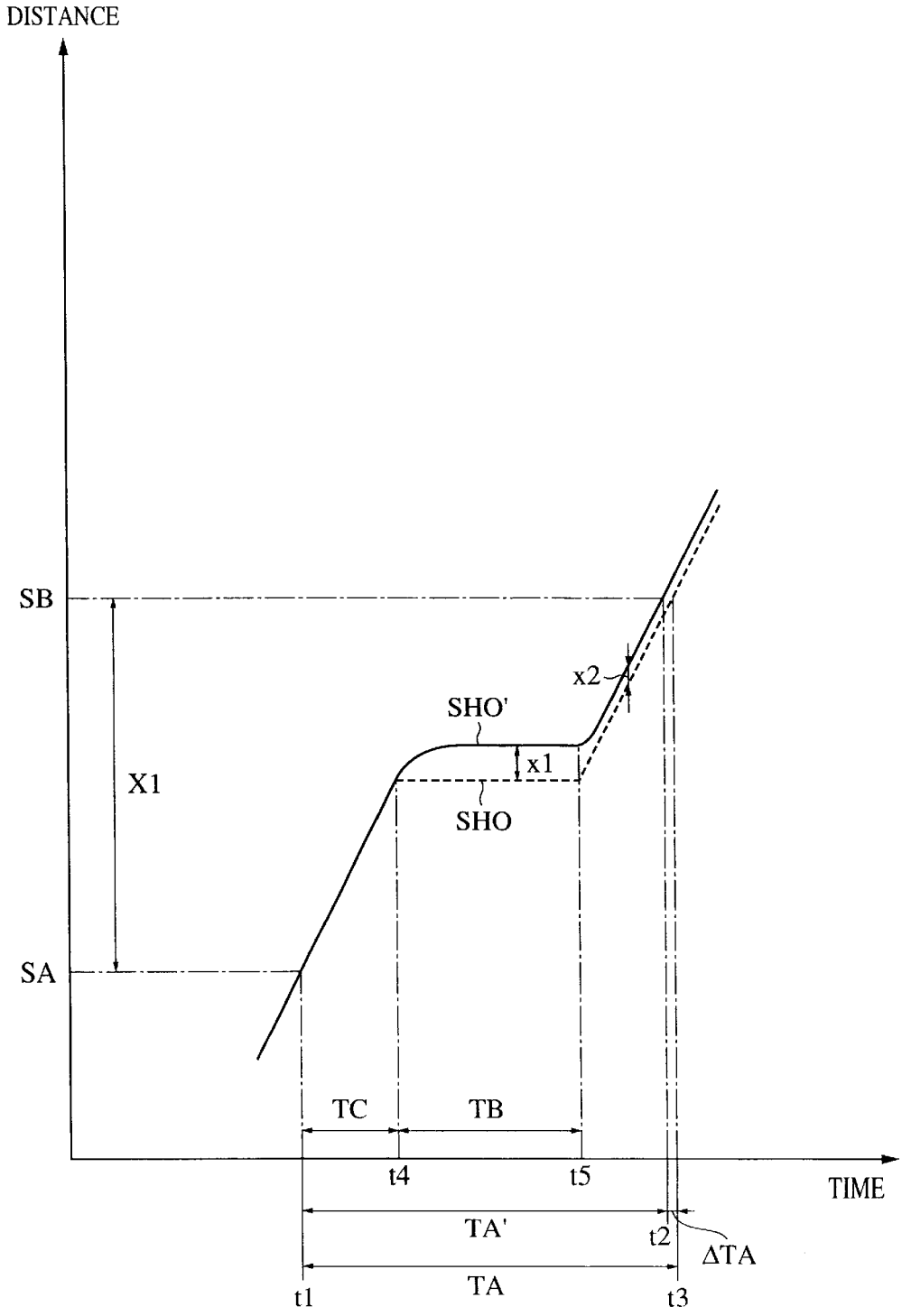
FIG. 5 illustrates roller properties when the clutch is connected after release.

FIG. 5 illustrates movement of the sheet SH (roller RA properties) in a case where the sheet SH is temporarily stopped by releasing the clutch CA during conveyance of the sheet SH by means of the roller RA, and then, the sheet SH is conveyed again by causing connection of the clutch CA. The ordinate represents the distance of the sheet SH, and the abscissa represents the time. SHO illustrates movement of the virtual sheet SH which stops instantaneously at time t4, and is immediately conveyed at a prescribed speed V1 at time t5. SHO' represents movement of the actual sheet SH.

In a state in which the roller RA conveys the sheet SH conveyed from the upstream, when the time t4 is reached after temporary stoppage of the sheet SH, the roller RA is stopped by releasing the clutch CA. Then, at the time t5 for resuming conveyance of the sheet SH, the roller RA is driven by connecting the clutch CA. Because the roller RA is stopped only by releasing the clutch CA, the sheet SH stops at a position ahead by an amount of lead x 1 from a virtual stop position as shown by SHO' in FIG. 5. As described above, the mount of lead x1 varies with the kind of the roller bearing, the roller material, the mechanical structure of roller driving, and differences between rollers. Complete connection of the clutch CA requires some time. There occurs therefore a time lag in start of conveyance of the sheet SH. As a result, the amount of lead of the sheet SH relative to the position SHO of the virtual sheet SH is reduced by x2.

In general, the amount of lead of the sheet from clutch release to roller stoppage is larger than the amount of delay of the sheet during clutch connection. When connecting the clutch CA after releasing the clutch CA, therefore, the sheet position is ahead the virtual sheet position by x2. As described later, connection of the clutch connecting timing is made so as to read the virtual sheet position by delaying the timing by an amount of lead x2, i.e., a period of time ΔTA.

The time ΔTA is calculable by measuring an actual time TA' from the time t1 when the leading edge of the sheet SH has passed by the sensor SA to the time t2 when the sheet passes by the sensor SB, and subtracting the time TA' from a virtual time TA on the assumption of an amount of lead of 0 with the released clutch CA and an amount of delay of 0 with a clutch CA connected (three hours from the time t1 when the sheet SH passes by the sensor SA to the time t3 when the sheet SH passes by the sensor SB). When the sheet SH is conveyed over a distance X1 from the sensor SA to the sensor SB at a speed V1, the virtual time TA is equal to the sum of the moving time X1/V1 of the sheet SH over the distance between the sensor SA-SB and the temporary stoppage time TB. Therefore, ΔTA can be determined by means of the following formula. The CPU 180 calculates ΔTA, and the CPU 180 stores ΔTA in the battery-backed-up RAM 184:

$$\begin{aligned}\Delta TA &= TA - TA' \\ &= (X1/V1 + TB) - TA' \\ &= X1/V1 - (TA' - TB)\end{aligned}$$

Figure 6:
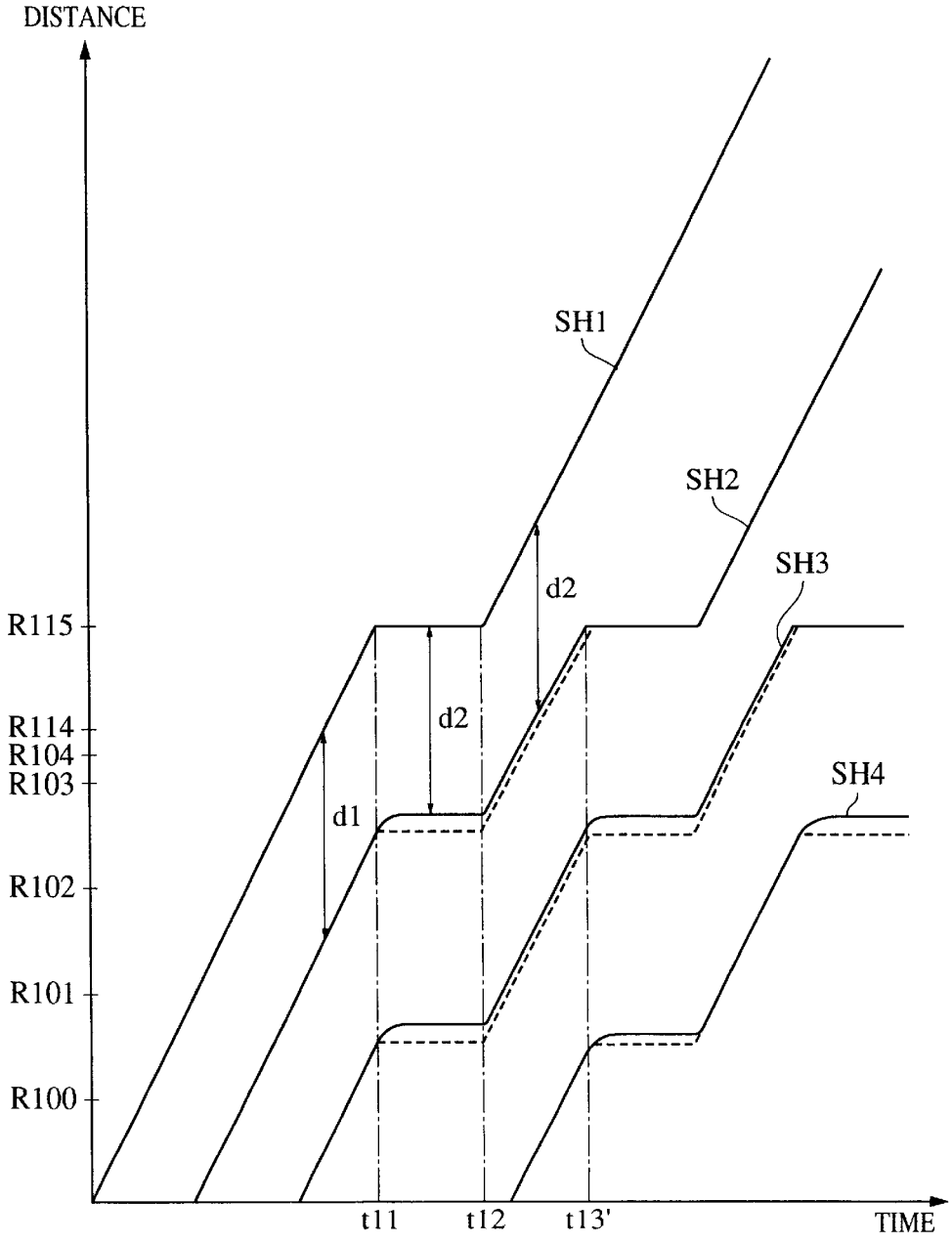
FIG. 6 illustrates movement of the sheet leading end without correction of ΔTA.
Figure 7:
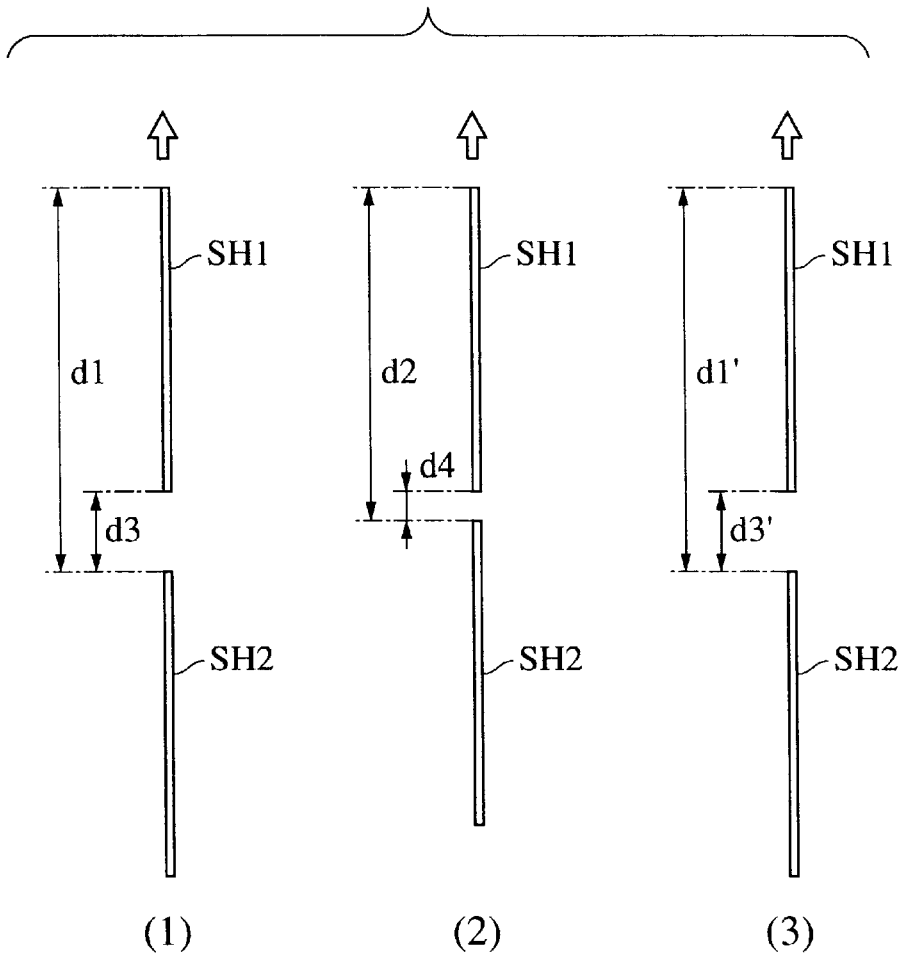
FIG. 7 illustrates the distance between the trailing edge of a sheet SH1 and the leading edge of a sheet SH2.

FIG. 6 illustrates movement of the sheet leading edge in a case where a correction of the above-mentioned ΔTA is not performed when continuously feeding sheets from the paper feeding cassette D108. In a state with the registration roller R115 in stoppage, sheets SH1, SH2 and SH3 are fed by use of the rollers R100, R101, R102, R103 and R114. The clutch C108 is connected in response to the detection of the trailing edge of the preceding sheet by the sensors S108 and S100 so that the distance between the leading edge of the preceding sheet and the leading edge of the following sheet become d1, i.e., so that the distance between the trailing edge of the preceding sheet and the following sheet becomes d3 as shown in FIG. 7(1). At a timing t11 when the leading edge of the sheet SH1 is fed to the roller 115, the rollers R114, R103, R102, R101 and R100 are stopped. The roller R114 is stopped through release of the clutch C114 and by means of the electromagnetic brake B114, and the rollers R103, R102, R101 and R100 are stopped exclusively through release of the clutches C103, C102, C101 and C100, respectively. Since the sheet SH2 advances during stoppage of the roller R102, the distance from the leading edge of the sheet SH1 to the leading edge of the sheet SH2 becomes d2 shorter than d1. Then, the sheet SH1 is fed by means of the resist rollers R115 and R114 at a prescribed timing t12 for image forming, and simultaneously with this, SH2 and SH3 are also conveyed through the rollers R114, R103, R102, R101 and R100. The sheet SH2 is therefore conveyed over the distance d2 between the leading edge of the sheet SH1 and the leading edge of the sheet SH2.

FIG. 7 illustrates the relationship between the distance from the leading edge of the sheet SH1 to the leading edge of the sheet SH2 and the distance from the trailing edge of the sheet SH1 to the leading edge of the sheet SH2. As shown in FIG. 7(1), when the distance from the leading edge of the sheet SH1 to the leading edge of the sheet SH2 is d1, the distance from the trailing edge of the sheet SH1 to the leading edge of the sheet SH2 is d3. This distance d3 is an interval corresponding to the time within which the flag 170 of the flag type sensor such as the sensor S104 can return from the sheet-present flag position (second position) to the sheet-absent position (first position) during the period from passage of the trailing edge of the sheet SH1 to the arrival of the leading edge of the sheet SH2. As shown in FIG. 7(2), when the distance from the leading edge of the sheet SH1 to the leading edge of the sheet SH2 is d2, the distance from the trailing edge of the sheet SH1 to the leading edge of the sheet SH2 is d4, which is shorter than d3.

When the distance from the trailing edge of the sheet SH1 to the leading edge of the sheet SH2 is insufficient for the flag 170 to return to the sheet-absent flag position during the period from passage of the trailing edge of the sheet SH1 by the sensor S104 to the arrival of the leading edge of the sheet SH2 at the sensor S104, the result of detection of the sensor S104 indicates the presence of a sheet continuously from the passage of the trailing edge of the sheet SH1 to the arrival of the leading edge of the sheet SH2. This state is erroneously detected as a stagnant jam although it is not a stagnant jam at all.

When the distance from the trailing edge of the sheet SH1 to the leading edge of the sheet SH2 is the distance at which the leading end of the sheet SH2 reaches the registration roller R115 during the period from passage of the trailing edge of the sheet SH1 through the registration roller R115 to complete stoppage of the registration roller R115, not only will skewing of the sheet SH2 not be corrected, but the occurrence of a positional shift of the leading edge of the sheet SH2 during standby will cause an unwanted positional shift of the image formed on the sheet.

Figure 10:
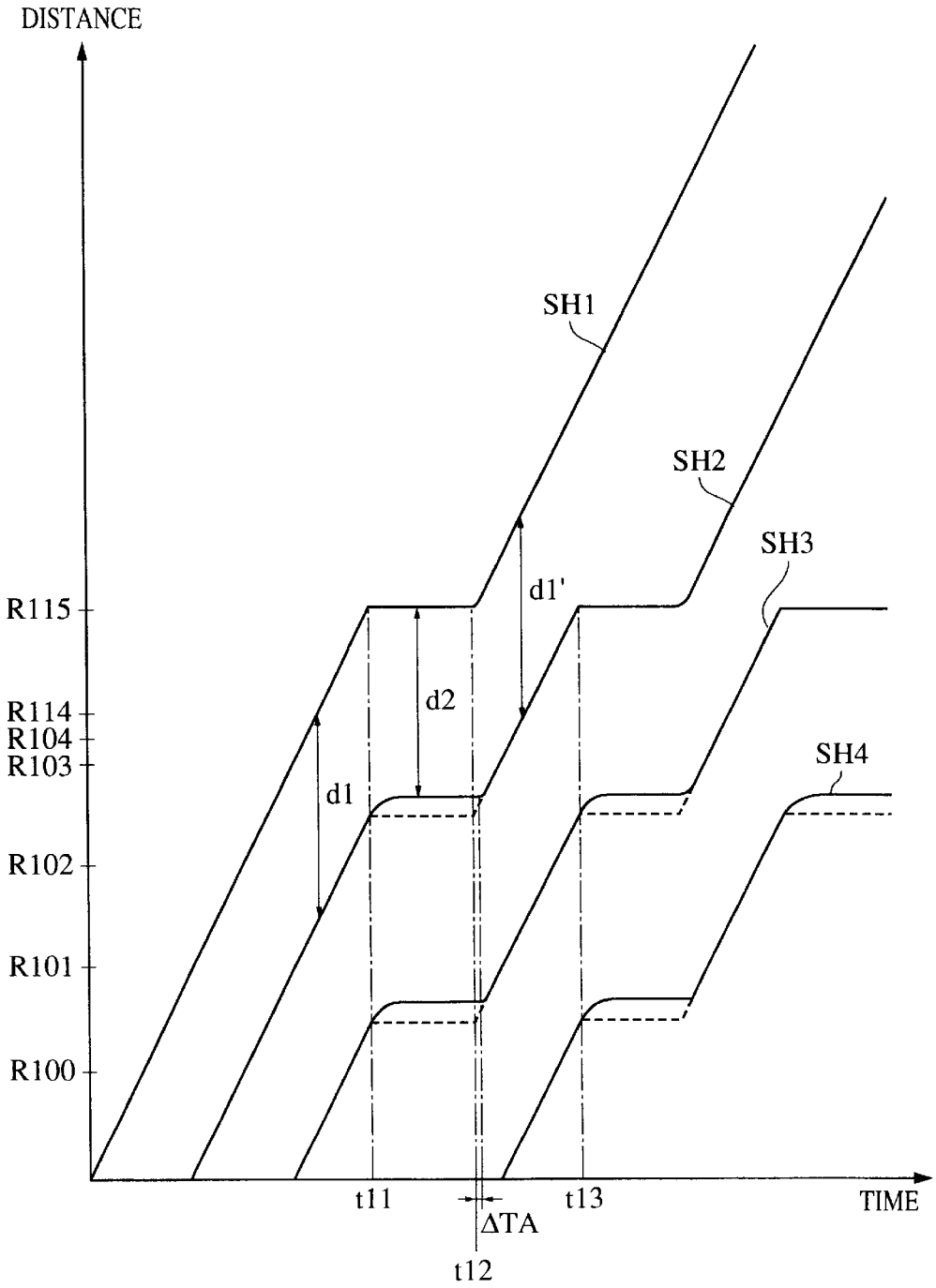
FIG. 10 illustrates movement of the sheet leading edge with correction of ΔTA.

FIG. 10 illustrates movement of the sheet leading edge in a case where the aforementioned correction of ΔTA is performed upon continuously feeding the sheet from the paper feeding cassette D108. The process up to the timing t12 is the same as shown in FIG. 7. The interval of sheet feeding from the paper feeding cassette D108 is adjusted through sheet separation and feeding conducted so as to achieve a distance d1 from the trailing edge of the preceding sheet to the leading edge of the following sheet. This distance d1 is a distance at which at least an erroneous detection of a stagnant jam or a positional shift of the image as described above do not occur, and reduced to permit improvement of productivity over the conventional level.

The sheet SH1 is fed through the registration rollers R115 and R114 at a prescribed timing t12 for image forming. After the lapse of ΔTA from the timing t12, SH2 is conveyed by use of the rollers R114, R103, R102 and R101. When the amount of lead of the sheet SH3 is the same as that of the sheet SH2, conveyance of the sheet SH3 is started at the same time as the sheet SH2. The sheet SH2 is conveyed in a state in which the distance from the leading edge of the sheet SH1 and the leading edge of the sheet SH2 is d1'. The distance between the leading edge of the sheet SH1 and the leading edge of the sheet SH2, being corrected by ΔTA, is d1'. While d1' is shorter than d1 due to a delay in the connection of the clutch C115, the distance corresponding to this connection delay of the clutch is smaller as compared with the amount of lead of the sheet upon clutch release in the upstream. This distance d1' is a distance at which at least the above-mentioned erroneous detection of the stagnant jam or a positional shift of the image does not occur.

Therefore, the distance between the trailing edge of the sheet SH1 and the leading edge of the sheet SH2 is corrected so that it is not erroneously detected as a stagnant jam by the sensor S104, thus permitting prevention of erroneous detection of a stagnant jam. The distance between the trailing edge of the sheet SH1 and the leading edge of the sheet SH2 is corrected to a distance at which, after passage of the trailing edge of the sheet SH1 through the registration roller R115 and stoppage of the registration roller R115, the leading edge of the sheet SH2 reaches the registration roller R115, preventing occurrence of a positional shift of the image.

That is, this is to correct, upon resuming sheet conveyance, a change in the sheet interval caused upon temporary discontinuance of sheet conveyance. More specifically, the timing of resumption of sheet conveyance is delayed by a period of time necessary to compensate fir the reduction of the sheet interval from the preceding sheet caused by temporary stoppage of each sheet.

The above-mentioned control is performed by the CPU 180. The CPU 180 reads out ΔTA from the battery-backed-up RAM 184 and carries out the above-mentioned correction control. A measured and calculated value of ΔTA is stored in the RAM 184, and correcting control is carried out by reading out the same, as described above. Control is not however limited to this, but the same advantages are available also by storing ΔTA previously determined in the design stage in the ROM 182, and conducting correcting control by reading the same from the ROM 182.

Figure 11:
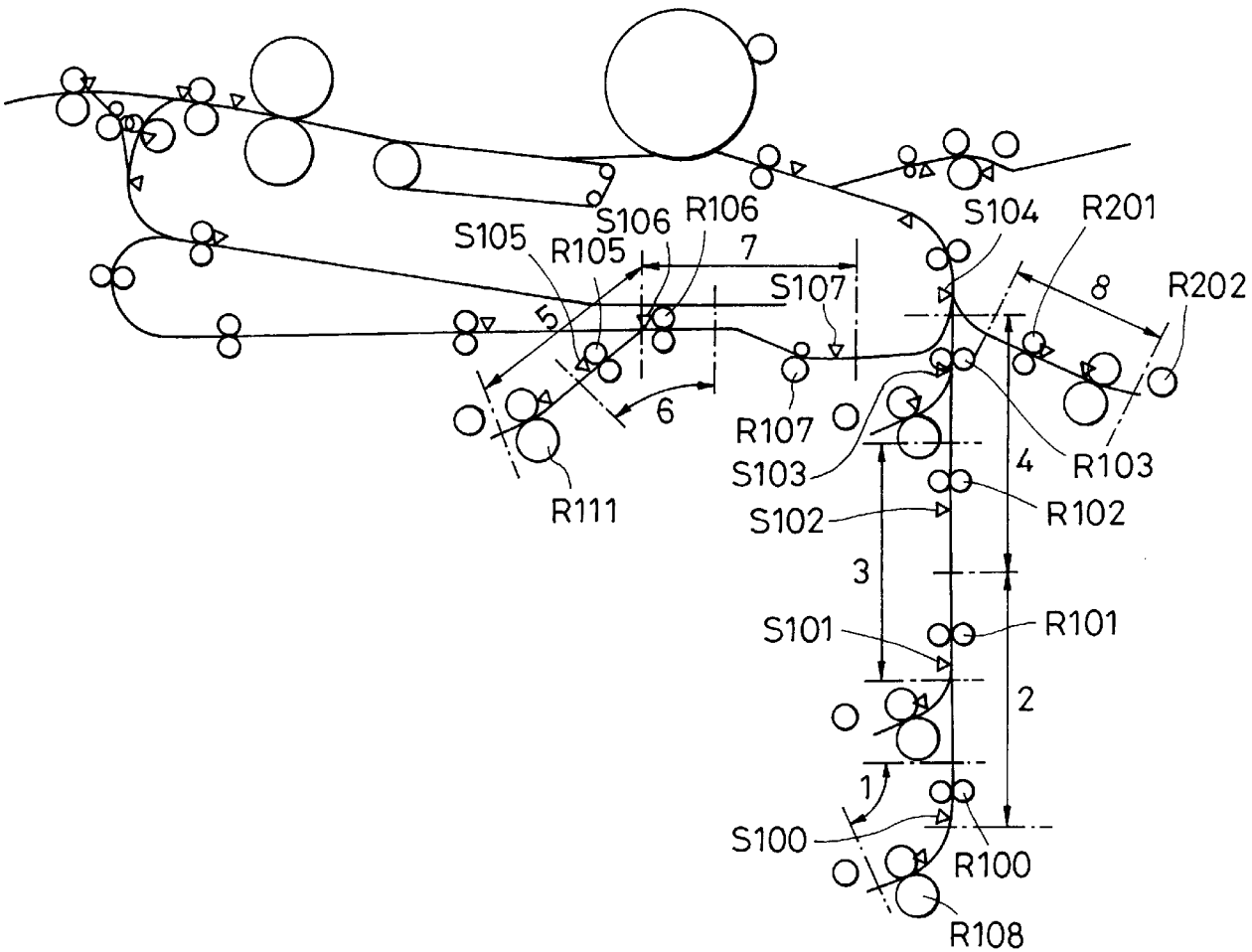
FIG. 11 illustrates a measuring area in clutch measuring mode.
Figure 12:
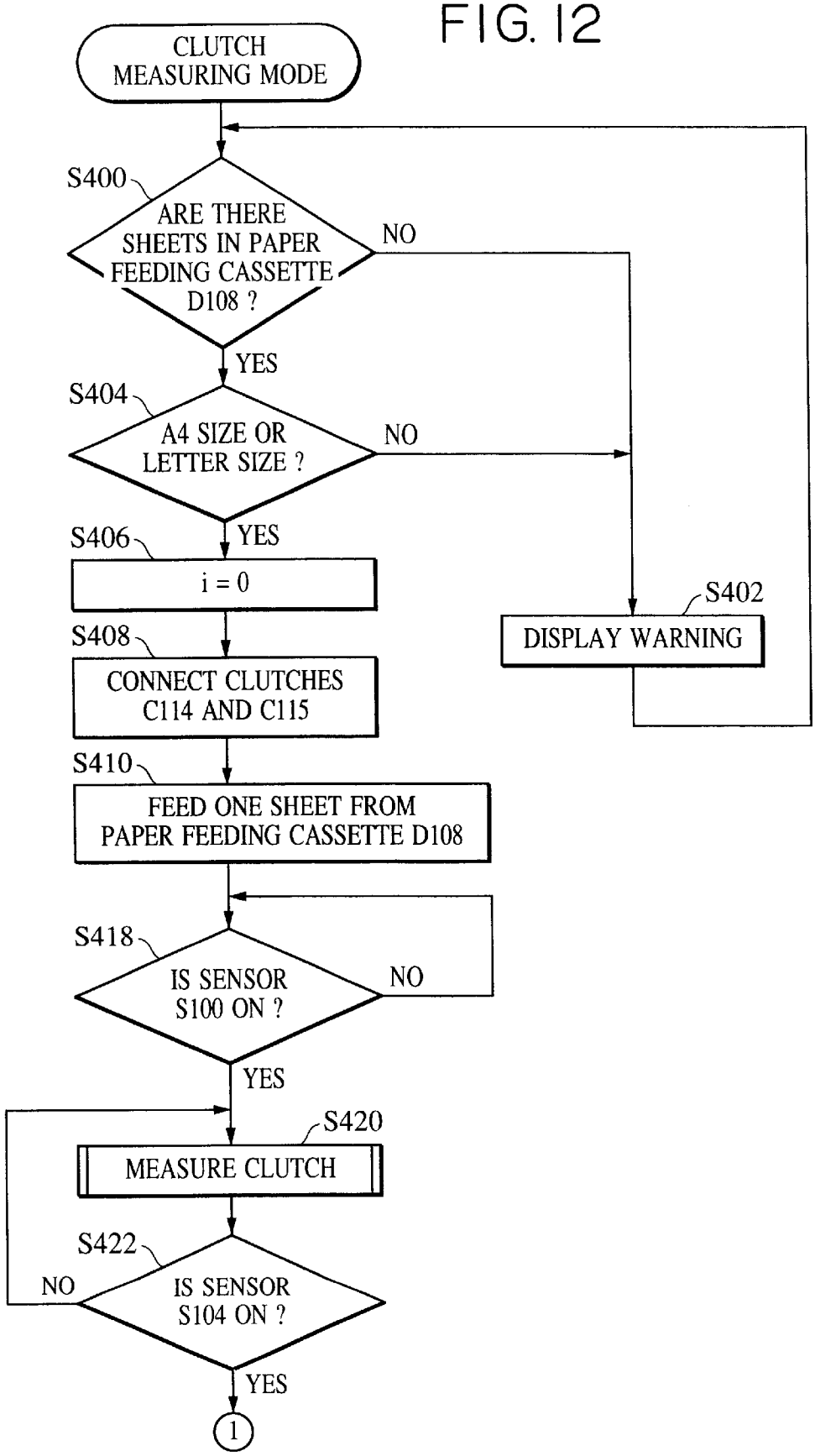
FIG. 12 is a flowchart in clutch measuring mode.
Figure 13:
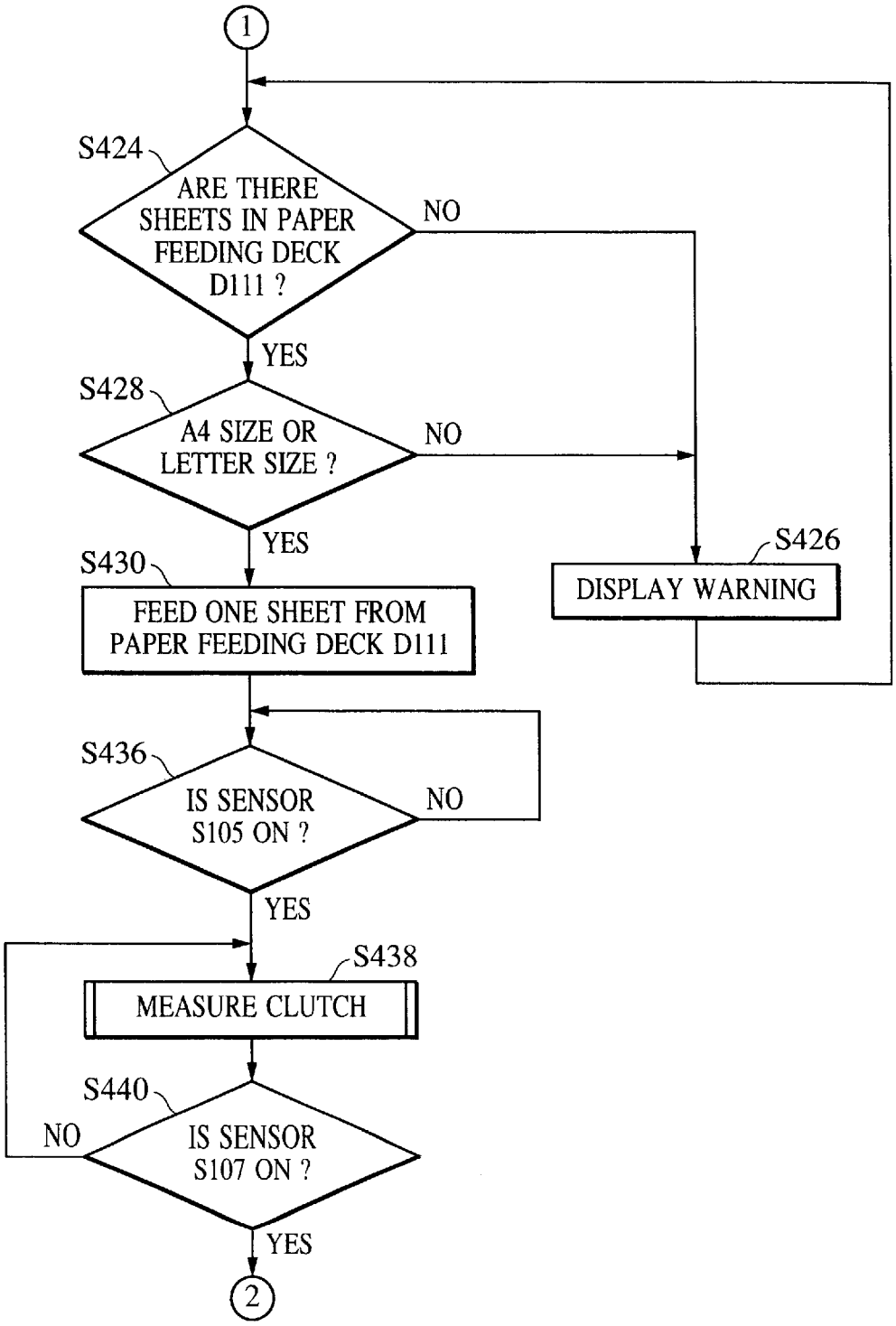
FIG. 13 is a flowchart in clutch measuring mode.
Figure 14:
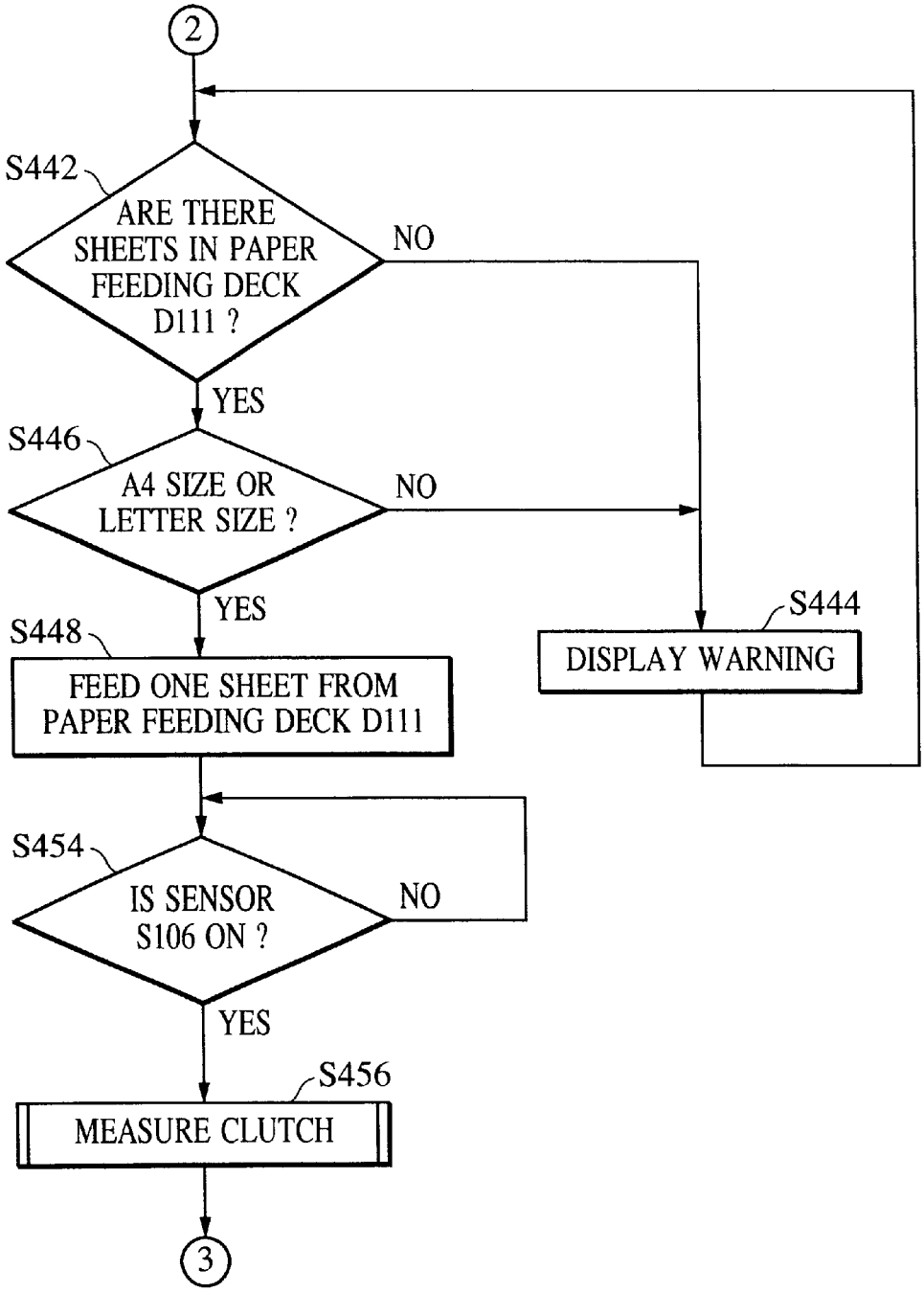
FIG. 14 is a flowchart in clutch measuring mode.
Figure 15:
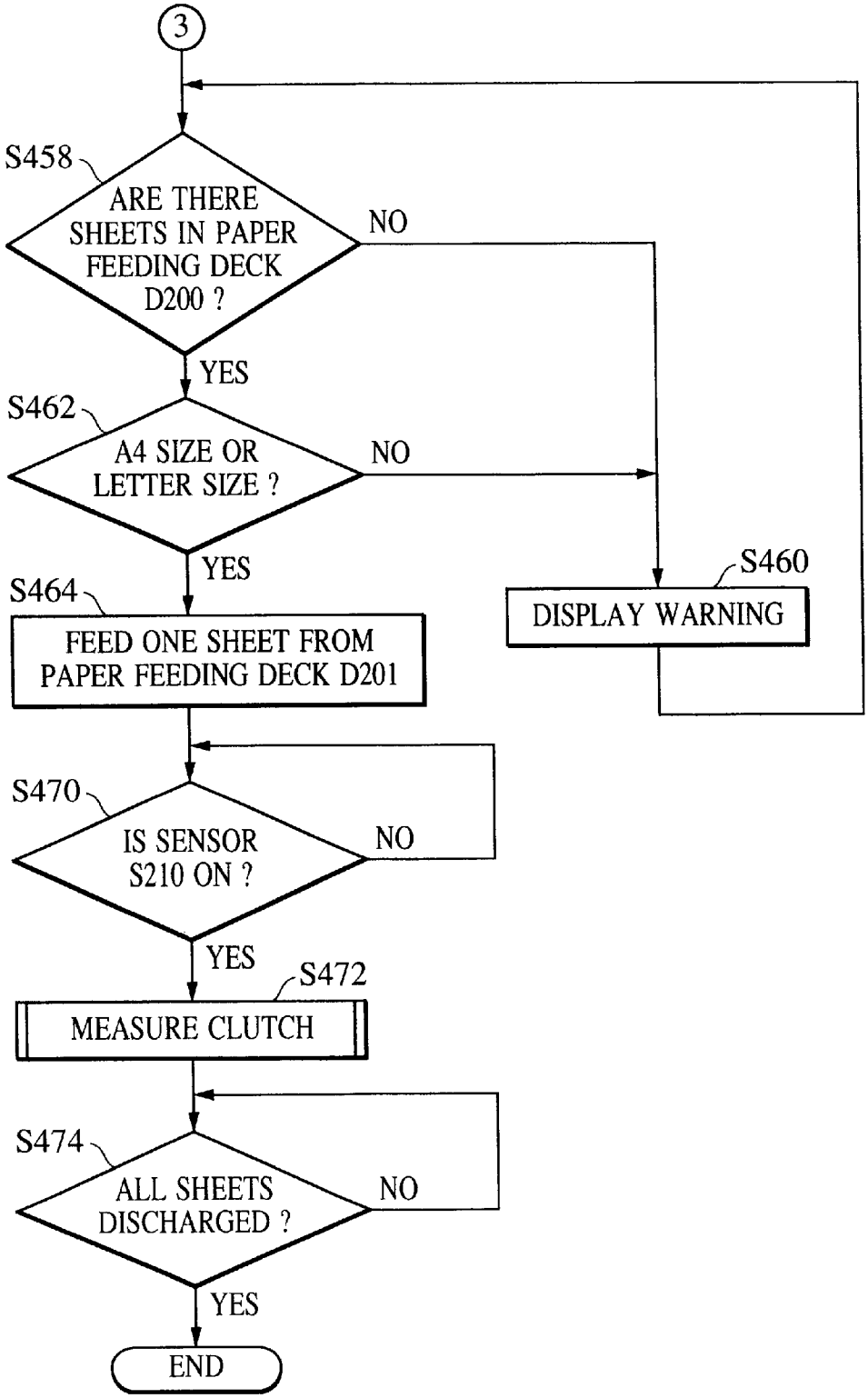
FIG. 15 is a flowchart in clutch measuring mode.

FIG. 11 and Table 2 show combinations of rollers holding A4-sized sheets or letter-sized sheets upon temporary discontinuance of sheet conveyance in the clutch measuring mode, i.e., measuring areas in the clutch measuring mode. Pieces of information except for ΔTA(i) in Table 2 are stored in the ROM 182. X1(i) represents the distance between the sensor SA(i) and the sensor SB(i). Regarding ΔTA(i), data matched with the measuring area numbers are stored in the RAM 184 in the clutch measuring mode described later.

TABLE 2

| Area i | Measuring/ feeding deck | Measuring roller | Sensor SA(i) | Sensor SB(i) | TC(i) | ΔTA(i) | X1(i) |
|---|---|---|---|---|---|---|---|
| 1 | D108 | R108(separation) · R100(sintered; rubber) | S100 | S101 | TC1 | ΔTA(1) | X1(1) |
| 2 | D108 | R100(sintered; rubber) · R101(sintered; rubber) | S101 | S102 | TC1 | ΔTA(2) | X1(2) |
| 3 | D108 | R101(sintered; rubber) · R102(ball; rubber) | S102 | S103 | TC1 | ΔTA(3) | X1(3) |
| 4 | D108 | R102(ball; rubber) · R103(ball; rubber) | S103 | S104 | TC1 | ΔTA(4) | X1(4) |
| 5 | D111 | R111(separation) · R105(sintered; rubber) | S105 | S106 | TC1 | ΔTA(5) | X1(5) |
| 6 | D111 | R105(sintered; rubber) · R106(sintered; rubber) | S106 | S107 | TC1 | ΔTA(6) | X1(6) |
| 7 | D111 | R106(sintered; rubber) · R107(ball; sponge) | S106 | S107 | TC2 | ΔTA(7) | X1(7) |
| 8 | D200 | R202(separation) · R201(sintered; rubber) | S201 | S104 | TC1 | ΔTA(8) | X1(8) |

FIGS. 12 to 15 are flowcharts of the clutch measuring mode. The program for executing these flowcharts is stored in the ROM 182, and read out and executed by the CPU 180. A clutch adjustment value measuring screen (FIG. 22) of service mode is displayed on the operator unit 300, and this clutch measuring mode is executed in response to a touch on the start key. At the start of execution of the clutch measuring mode, the CPU 180 turns on the motors 120, 128, 130 and other motors.

Whether or not there are sheets in the paper feeding cassette D108 is determined (S400) on the basis of the result of the detection by a sheet presence sensor provided on the paper feeding cassette D108. In the absence of sheets, a warning is displayed on the operator unit 300 to instruct the operator to set A4-sized or letter-sized sheets in the paper cassette D108 (S402). If sheets are present in the paper feeding cassette D108, it is determined whether the sheets are A4-sized or letter-sized on the basis of the result of detection by a sheet size sensor (S404). If the sheets are neither A4-sized nor letter-sized, the process advances to step S402.

When the sheets are determined to be A4-sized or letter-sized in step S404, 0 is set as a variable (S406). The clutches C114 and C115 are connected (S408), and a sheet is fed from the paper feeding cassette D108 (S410). A pickup roller of the roller R108 is driven by a solenoid. When the solenoid is turned off, the pickup roller is in contact with the sheet within the paper feeding cassette D108. In order to feed a sheet from the paper feeding cassette D108, the pickup roller and the roller R108 are driven by connecting the clutch C108. At the point in time when the sensor S108 is turned on, the solenoid of the pickup roller is turned on to separate the pickup roller from the sheet in the paper feeding cassette D108.

Then, upon turn-on of the sensor S100 (S418), the clutch measuring process described later is executed (S420). The clutch measuring process is repeated until the sensor S104 is turned on (S422). That is, measurement of a plurality of areas is conducted with a single sheet. More specifically, the time from detection of an end of the sheet by the second sensor to detection of the end of the sheet by the third sensor is measured by discontinuing sheet conveyance in the middle between the first and second sensors, resuming sheet conveyance after the lapse of a predetermined time, measuring the time from detection of a sheet edge by the first sensor to detection of the sheet edge by the second sensor, stopping, between the second and third sensors, the sheet having once been stopped between the first and second sensors, and resuming sheet conveyance after the lapse of a predetermined time.

Then, it is determined whether or not there are sheets in the paper feeding deck D111 on the basis of the result of detection by a sheet presence sensor provided on the paper feeding deck D111 (S424). In the absence of sheets, a warning is displayed to the operator 300 to instruct it to set A4-sized or letter-sized sheets in the paper feeding deck D111 (S426). In the presence of sheets in the paper feeding deck D111, it is determined whether the sheets are A4-sized or letter-sized on the basis of the result of detection by a sheet size sensor (S428). If the sheets are neither A4-sized nor letter-sized, the process advances to step S426.

When the sheets are determined to be A4-sized or letter-sized in step S428, a sheet is fed from the paper feeding deck D111 (S430). A pickup roller of the roller R111 is driven by a solenoid. When the solenoid is turned off, the pickup roller is in contact with the sheet within the paper feeding deck D111. In order to feed a sheet from the paper feeding deck D111, the pickup roller and the roller R111 are driven by connecting the clutch C111. At the point in time when the sensor S111 is turned on, the solenoid of the pickup roller is turned on to separate the pickup roller from the sheet in the paper feeding deck D111.

Then, upon turn-on of the sensor 105 (S436), the clutch measuring process is executed (S438). The clutch measuring process is repeated until the sensor S107 is turned on (S440).

No sensor is provided between the rollers R106 and R107 in the image forming apparatus of this embodiment. It is therefore necessary to conduct all the measurements of the area 6 and the area 7 by means of the sensors S106 and S107 (FIG. 11). The sheet used for the measurement of the area 6 must be discharged, and it is necessary to carry out measurement of the area 7 by use of the sensors S106 and S107 by feeding another sheet.

Therefore, another A4-sized or letter-sized sheet is fed again from the paper feeding deck D111. It is determined whether or not there are sheets in the paper feeding deck D111 on the basis of the result of detection by a sheet-presence sensor provided on the paper feeding deck D111 (S442). In the absence of sheets, a warning is displayed to the operator 300 to instruct it to set A4-sized or letter-sized sheets in the paper feeding deck D111 (S444). In the presence of sheets in the paper feeding deck D111, it is determined whether the sheets are A4-sized or letter-sized on the basis of the result of detection by a sheet size sensor (S446). If the sheets are not A4-sized nor letter-sized, the process advances back to step S444.

When the sheets are determined to be A4-sized or letter-sized in step S446, a sheet is caused to be fed from the paper feeding deck D111 as in S430 (S448).

Then, upon turn-on of the sensor S106 (S454), the clutch measuring process is executed (S456). In the clutch measuring mode, measurement is accomplished by feeding two sheets in total from the paper feeding deck D111.

Then, it is determined whether or not there are sheets in the paper feeding deck D200 on the basis of the result of detection by a sheet-presence sensor provided on the paper feeding deck D200 (S358). In the absence of sheets, a warning is displayed to the operator on operator unit 300 to instruct the operator to set A4-sized or letter-sized sheets in the paper feeding deck D200 (S460). In the presence of sheets in the paper feeding deck D200, it is determined whether the sheets are A4-sized or letter-sized on the basis of the result of the detection by a sheet size sensor (S462). If the sheets are not A4-sized nor letter-sized, the process advances back to S460.

When the sheets are determined to be A4-sized or letter-sized in step S462, the paper feeding deck D201 is caused to feed a sheet (S464). A pickup roller of the roller R201 is driven by a solenoid. When the solenoid is turned off, the pickup roller is in contact with the sheet within the paper feeding deck D201. In order to feed a sheet from the paper feeding deck D201, the pickup roller and the roller R111 are driven by connecting the clutch C201. At the point in time when the sensors 201 are turned on, the solenoid of the pickup roller is turned on to separate the pickup roller from the sheet in the paper feeding deck D201.

Then, upon turn-on of the sensors 201 (S470), the clutch measuring process is executed (S472). When a sensor provided on the paper discharge detects discharge of all the sheets after the clutch measuring process, the process is completed (S474).

Figure 16:
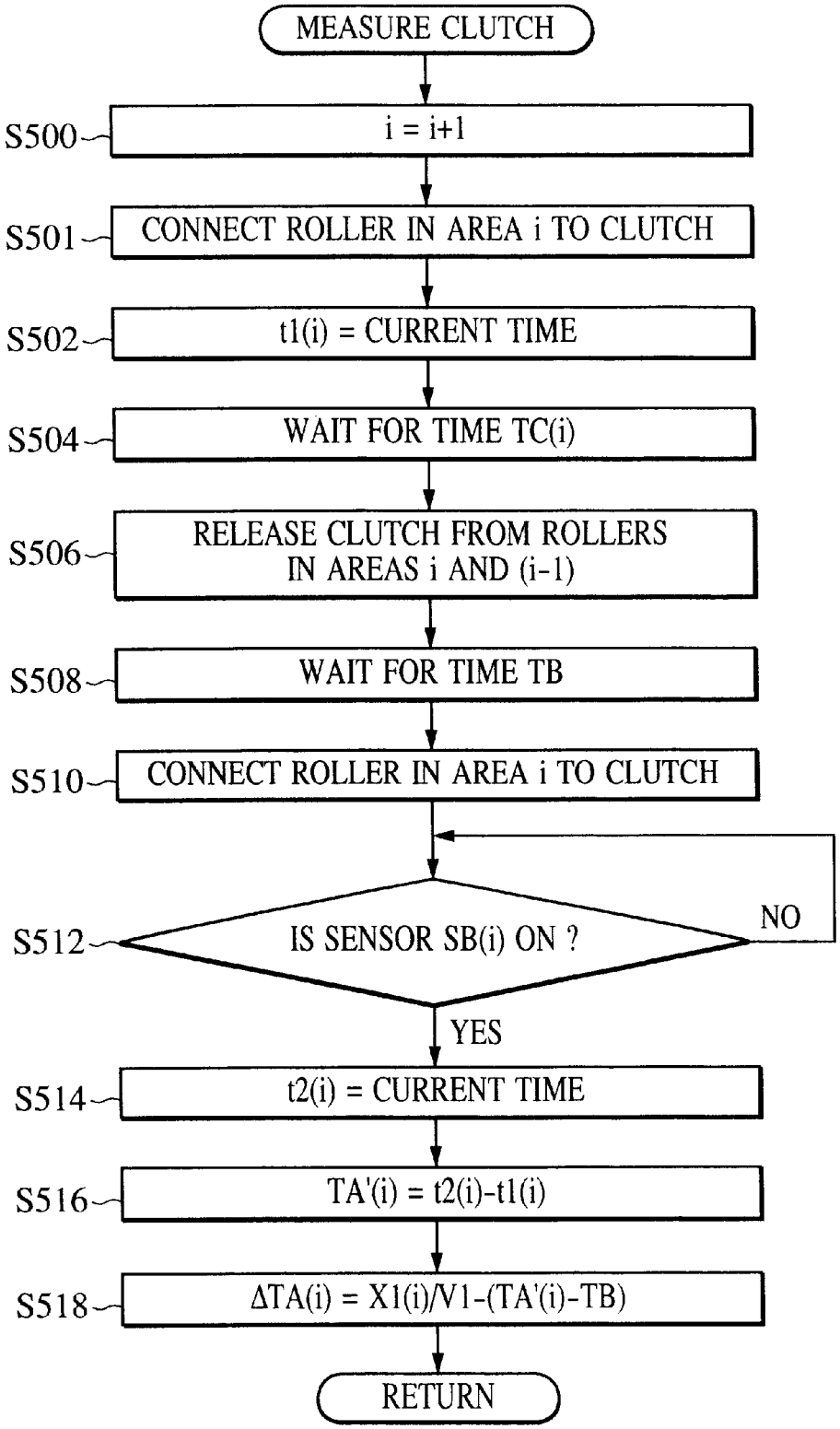
FIG. 16 is a flowchart of a clutch measuring process.

FIG. 16 is a flowchart of the clutch measuring process invoked by the above-mentioned clutch measuring mode. A program for executing this flowchart is stored in a ROM 182, read out by the CPU 180, and executed. The CPU 180 has a built-in free-run counter for current time control. During execution of the program, the counter is automatically counted up, and the CPU 180 can thus control the current time through this counter.

First, variable i is incremented by 1 (S500). With reference to the rollers with area i shown in Table 2 stored in the ROM 182, the corresponding clutches are connected (S501), and the current time is set as t1(i) (S502). Then, with reference to TC(i) in Table 2 stored in the ROM 182, the clutch of the roller in area i and area (i−1) is released after waiting for a time TC(i) (S504) (S506). Since area 0 does not exist when variable i is 1, the clutch of the roller in area 1 is released. After waiting for time TB (S508), the clutches of the roller within area i is connected (S510). With reference to SB(i) in Table 2, output of the sensor SB(i) is monitored, and when the sensor SB(i) is turned on (S512), the current time is set as t2(i) (S514). Then, t2(i)−t1(i) is determined, and TA' (i) is set (S516). With reference to X1(i) in Table 2, X1(i)/V1−(TA'(i)−TB) is calculated, and the result is matched with the area No. i as ΔTA(i). The result is stored in the RAM 184 (S518), and the process goes back to the clutch measuring mode shown in FIGS. 12 to 15.

Measurement in each area is performed as described above. TC1 is a time sufficient for the leading edge of the sheet to pass through the roller positioned first downstream of the sensor SA(i), and insufficient for the leading edge of the sheet to reach the second roller downstream of the sensor SA(i) and the sensor SB(i). TC2 is a time sufficient for the leading edge of the sheet to pass through the second roller in the downstream of the sensor SA(i) and insufficient for the leading edge of the sheet to reach the sensor SB(i).

As shown in FIG. 22, whether the measurement is underway or has been completed is displayed on the operator unit 300. As shown in FIG. 23, ΔTA(i) may be displayed on the operator unit 300.

Figure 17:
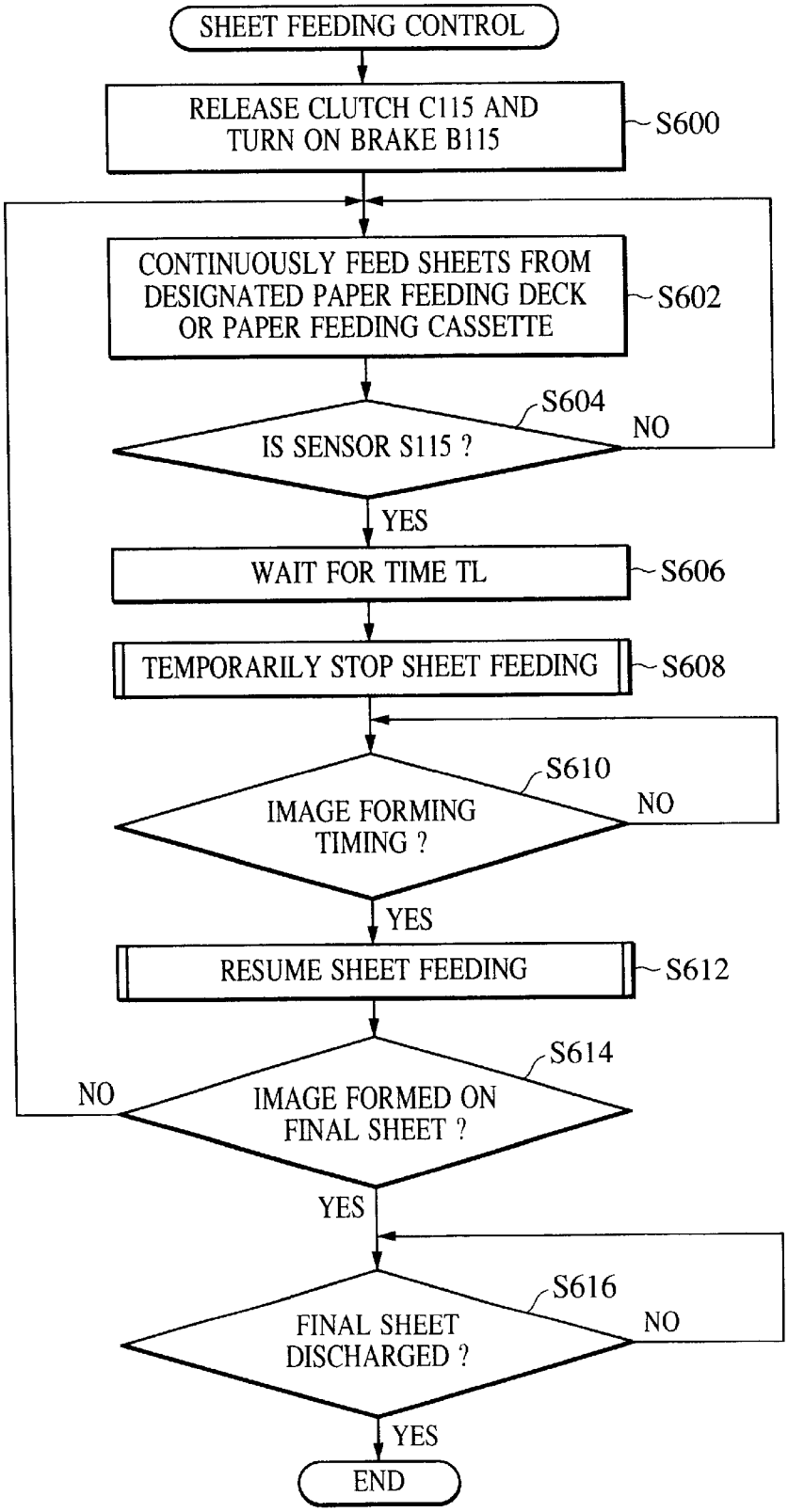
FIG. 17 is a flowchart of sheet feeding control.

FIG. 17 is a flowchart for sheet feeding control for feeding a sheet from any of the paper feeding decks D110, D111 and D200, or the paper feeding cassettes D108 and D109, to the photosensitive drum 152 when the image forming apparatus forms an image. A program for executing this flowchart is stored in the ROM 182, read out by the CPU 180, and executed.

To correct a skewing of the sheet by use of the registration roller R115, the clutch C115 is released to bring the registration roller R115 into stoppage, and the brake B115 is turned on (S600). Sheets are continuously fed from a paper feeding deck or a paper feeding cassette specified by the operator unit 300 so that the distance between the trailing edge of the preceding sheet and the leading edge of the following sheet becomes d3 (S602). In step S602, sheet feeding is controlled on the basis of the result of sensor detection of the amount of conveyed sheets and the conveying time of the sheet, and leading edge positional information (distance from the registration roller R115) always showing the latest leading edge position of each sheet is stored, together with size information of each sheet, in the RAM 184. It is determined whether or not the sensor S115 is turned on, i.e., whether or not the leading edge of the sheet at the top has reached the sensor S115 (S604). If it is not turned on, step S602 is continued. When it detected to be turned on in step S604, the process waits for a time TL (S606), and the sheet feeding temporary stoppage described later is executed (S608). In the sheet feeding temporary stoppage process, the sheet at the top of the process is temporarily stopped, and all the following sheets are temporarily stopped so as to avoid rear-edge collision of the following sheet with the preceding sheet. TL is the time during which sheets in a predetermined amount are conveyed after passage of the leading edge of the sheet by the sensor S115 and collision with the nip of the registration roller R115.

At a timing when the image formed on the photosensitive drum 152 agrees with the sheet (S610), the sheet feeding resuming process described later is executed (S612). It is determined whether or not this sheet is the final one on which an image is formed (S614). If it is not the final sheet, the process returns to step S602. If it is, the process comes to an end at the moment when the final sheet is discharged through a discharge roller (S616).

Figure 18:
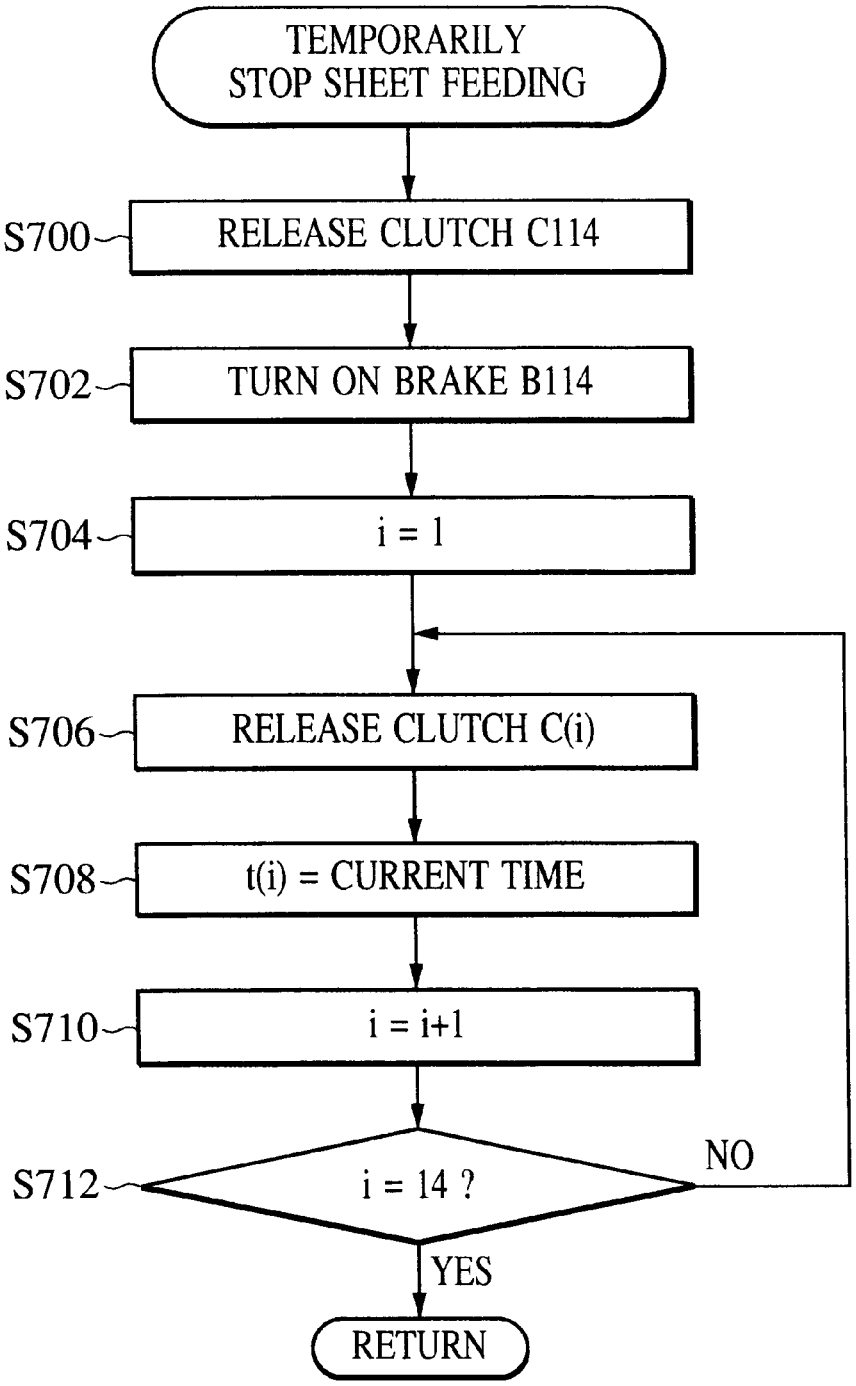
FIG. 18 is a flowchart of sheet feeding temporary discontinuance.

FIG. 18 is a flowchart of the sheet feeding temporary stoppage process invoked in the aforementioned sheet feeding control. A program for executing this flowchart is stored in the ROM 182, which is read out and executed by the CPU 180. The sheet feeding temporary stoppage process is carried out in the clutch control sequence shown in Table 3, and is stored in the ROM 182. This clutch control sequence is a sequence from the one closes to the registration roller R115, i.e., a sequence from the downstream toward the upstream. The clutch C114 is first released (S700), and the brake B114 is turned on (S702). The variable i is set as 1 (S704), and the clutch C(i) shown in Table 3, stored in the ROM 182 is released (S706).

TABLE 3

| Clutch control sequence, i | Clutch C(i) |
|---|---|
| 1 | C103 |
| 2 | C201 |
| 3 | C110 |
| 4 | C202 |
| 5 | C102 |
| 6 | C107 |
| 7 | C106 |
| 8 | C101 |
| 9 | C105 |
| 10 | C109 |
| 11 | C111 |
| 12 | C100 |
| 13 | C108 |

The current time is set as t(i) (S708), and 1 is added to the variable i (S710). It is determined whether or not the variable i has become 14. If not, the process returns back to step S706, and if the variable i has become 14, the process returns to the sheet feeding control shown in FIG. 17.

Figure 19:
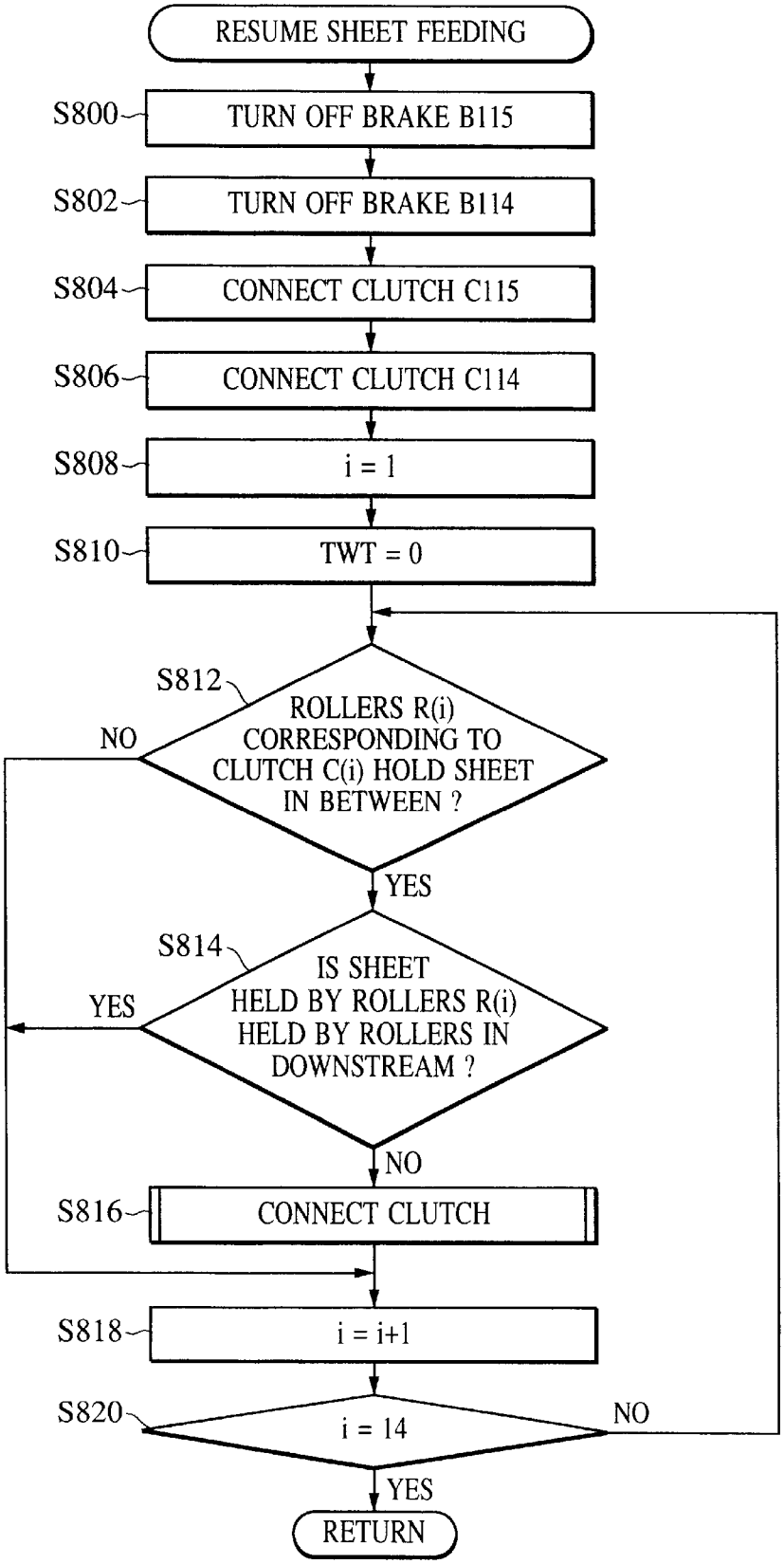
FIG. 19 is a flowchart of the sheet feeding resuming process.

FIG. 19 is a flowchart of the sheet feeding resuming process invoked through the aforementioned sheet feeding control. A program for executing this flowchart is stored in the ROM 182, which is read out and executed by the CPU 180. In the sheet feeding resuming process, the brakes B115 and B114 are turned off (S800 and S802), and the clutches C115 and C114 are connected (S804 and S806). Then, 1 is set as the variable i (S808), and 0 is set as the total waiting time variable TWT (S810). It is determined whether or not the roller R(i) corresponding to the clutch C(i) holds the sheet (S812) with reference to the leading edge positional information of each sheet in the conveying path, stored in the RAM 184 (distance from the registration roller R115) and the positional information of the roller R(i) corresponding to the clutch C(i) stored in the ROM 182 (distance from the registration roller R115). When the roller R(i) is determined to hold the sheet, it is determined whether or not the sheet held by the roller R(i) is held by a downstream-side roller (roller on the photosensitive drum 152 side)(S814) with reference to the leading edge positional information of each sheet in the conveying path, stored in the RAM 184 and the positional information of the other rollers stored in the ROM 182. When the sheet held by the roller R(i) is not held by a downstream-side roller, the clutch connecting process described later is carried out (S816), and 1 is added to the variable i (S818). When it is determined that the roller R(i) does not holed the sheet in step S812, or that the sheet held by the roller R(i) is held by a downstream-side roller, the process proceeds to step S818. After step S818, it is determined whether or not the variable i has become 14 (S820). If not, the process returns to step S812. When the variable i has become 14, the process goes back to sheet feeding control shown in FIG. 17.

Figure 20:
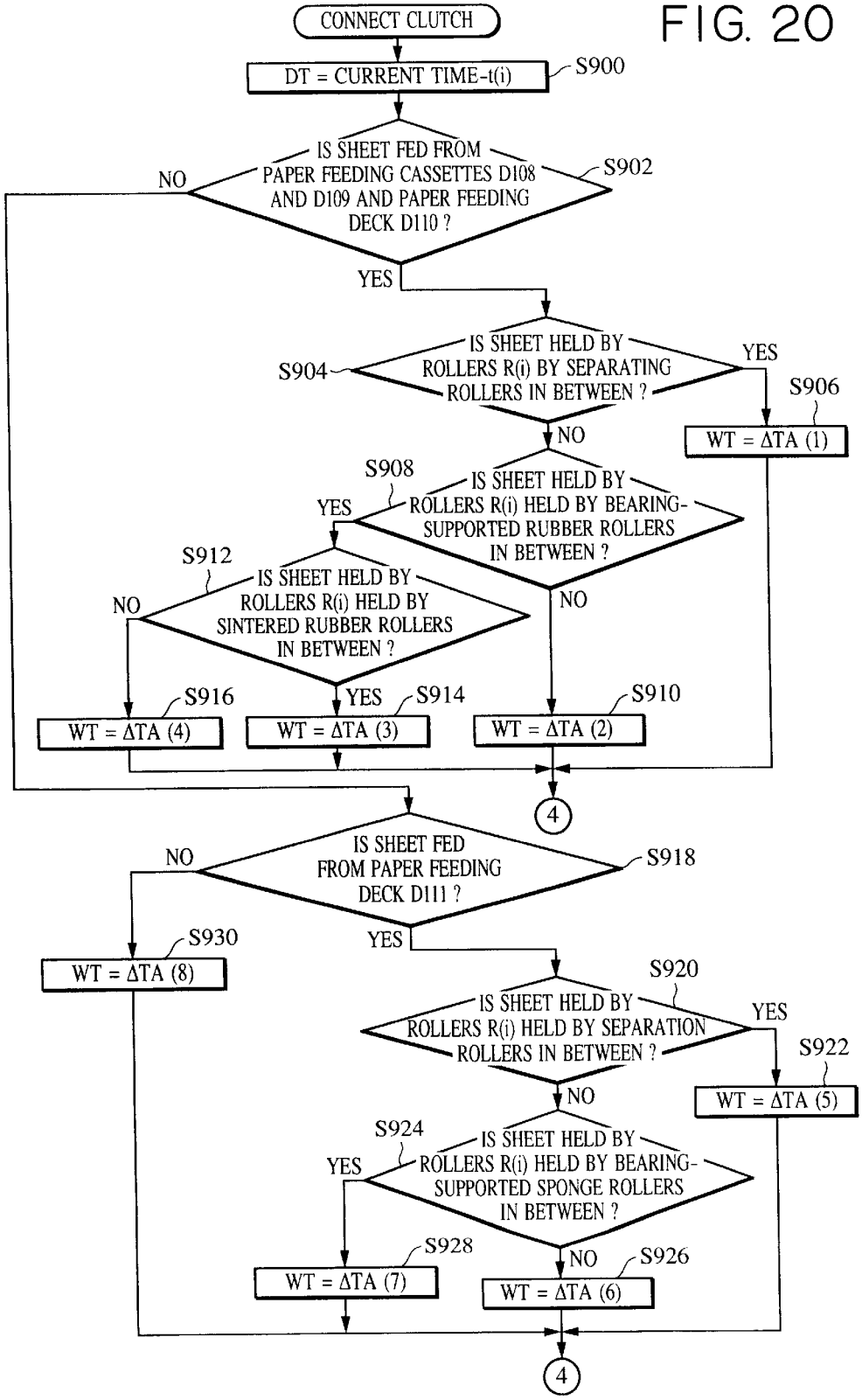
FIG. 20 is a flowchart of the clutch connecting process.
Figure 21:
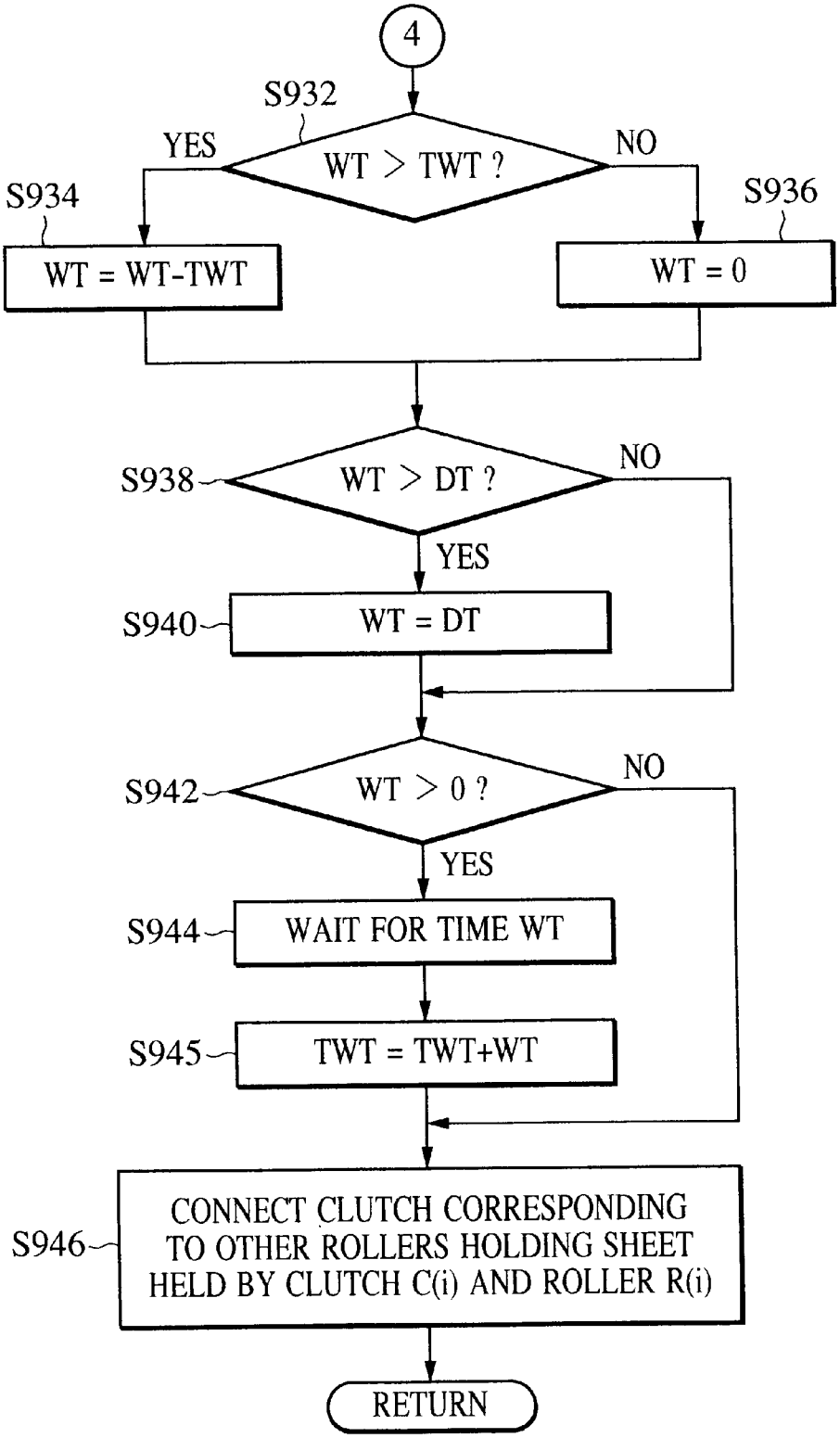
FIG. 21 is a flowchart of the clutch connecting process.

FIGS. 20 and 21 are flowcharts of the clutch connecting process invoked in the aforementioned sheet feeding resuming process. A program for executing these flowcharts is stored in the ROM 182, which is read out and executed by the CPU 180. In the clutch connecting process, a current time −t(i) is determined and set as a variable DT (S900). It is determined from which of the paper feeding cassettes D108 and D109 and the paper feeding deck D110 the sheets are fed (S902). If the sheet is fed from any of the paper feeding cassettes D108 and D109 and the paper feeding deck D110, it is determined whether or not the sheet held by the roller R(i) is held by the separating roller (S904) with reference to the leading edge positional information of each sheet in the conveying path, stored in the RAM 184, and the roller positional information and the roller kind information stored in the ROM 182. When the sheet is held by the roller R(i) is held by the separating roller, the sheet is affected by the separating roller having a short stoppage time even when the sheet is held by another roller. ΔTA(i) is set as a waiting time variable W (S906).

When the sheet held by the roller R(i) is determined not to be held by the separating roller in step S904, it is determined whether or not the sheet held by the roller R(i) is held by the bearing rubber roller (S908) with reference to the ROM 182 and the RAM 184 in the same manner as above. When it is determined that the sheet held by the roller R(i) is not held by the bearing rubber roller, ΔTA(2) is set as the variable WT, because the sheet is held only by the sintered bearing rubber roller (S910). When the sheet held by the roller R(i) is determined to be held by the bearing rubber roller, it is determined whether or not the sheet held by the roller R(i) is held by the sintered bearing rubber roller (S912) with reference to the ROM 182 and the RAM 184 as above. When the sheet held by the roller R(i) is determined to be held by the sintered bearing rubber roller, the sheet is held by the sintered bearing rubber roller and the bearing rubber roller, and ΔTA(3) is set as the variable WT (S914). When the sheet held by the roller R(i) is determined not to be held by the sintered bearing rubber roller, ΔTA(4) is set as the variable WT, because the sheet is held exclusively by the bearing rubber roller (S916).

When sheets are fed from the paper feeder other than the paper feeding cassettes D108 and D109 and the paper feeding deck D110, it is determined whether or not the sheet is fed from the paper feeding deck D111 (S918). If the sheet is fed from the paper feeding deck D111, it is determined whether or not the sheet held by the roller R(i) is held by the separating roller with reference to the ROM 182 and the RAM 184 as above (S920). When the sheet held by the roller R(i) is determined to be held by the separating roller, the separating roller having a shorter time of stoppage inevitably affect the sheet even when the sheet is held by any other roller. Therefore, ΔTA(5) is set as the variable WT (S922). When the sheet held by the roller R(i) is determined not to be held by the separating roller, it is determined whether or not the sheet held by the roller R(i) is held by the bearing sponge roller, with reference to the ROM 182 and the RAM 184 as above (S924). When the sheet held by the roller R(i) is not held by the bearing sponge roller, the sheet is held only by the sintered bearing rubber roller. Therefore, ΔTA(6) is set as the variable WT (S926). When the sheet held by the roller R(i) is held by the bearing sponge roller, the sheet is held by the sintered bearing rubber roller and the bearing sponge roller. Therefore, ΔTA(7) is set as the variable WT (S928). When the sheet is fed from the paper feeding deck D111 in step S918, ΔTA(8) is set as the variable WT (S930).

In the image forming apparatus of this embodiment, when feeding a sheet having the same size as the sheet used in clutch measuring mode for sheet feeding control, the measured data are used. When a sheet larger in size than the sheet used in the clutch measuring mode is held by three or more rollers, and there exist combinations of rollers not measured in the clutch measuring mode, data of the shortest period from clutch release to stoppage is selected from among a plurality of areas to which the rollers holding the sheet belong.

After setting data as the variable WT in steps S906, S910, S914, S916, S922, S926, S928 and S930, it is determined whether or not the variable WT is larger than the variable TWT (S932). When the variable WT is larger than the variable TWT, WT−TWT is determined, and a value is set as the variable WT (S934). When the variable WT is smaller than the variable TWT, 0 is set as the variable WT (S936). In this case, the driving timing of the clutch corresponding to the roller holding the following sheet is adjusted in response to the delay in driving of the clutch corresponding to the roller holding the preceding sheet.

After setting data for the variable WT in steps S934 and S936, it is determined whether or not the variable WT is larger than the variable DT (S938). When the variable WT is larger than the variable DT, a value of DT is set as the variable WT (S940). When the temporary release time of the clutch C(i) is shorter than the delay time of clutch connection, i.e., the time required before roller stoppage (sheet stoppage), the amount of lead during temporary release of the clutch C(i) never exceeds the amount of lead before stoppage of the roller R(i). It suffices to delay by a time corresponding to the temporary release time of the clutch C(i) on the maximum. Then, it is determined whether or not the variable WT is larger than 0 (S942). When the variable WT is smaller than DT in step S938, the process proceeds to step S942. When the variable WT is larger than 0 in step S942, waiting is made for time WT (S944), and the clutch corresponding to the roller holding the sheet held by the clutch C(i) and the roller R(i) is connected (S946). A value obtained by adding WT to the variable TWT is set as the variable TWT (S945). When the variable WT is 0 in step S942, the process advances to step S946, and the clutch corresponding to the roller holding the sheet held by the clutch C(i) and the roller R(i) is immediately connected. Then, the process goes to the sheet feeding resuming process shown in FIG. 19.

It is to be understood that the phraseology or terminology employed herein is for the purpose of description and not of limitation.

While the invention has been described with reference to the embodiment disclosed herein, it is not confined to the details set forth and this application is intended to cover such modifications or changes as may come within the purposes of the improvements or the scope of the following claims.

What is claimed is:

1. A sheet conveying apparatus comprising:

a sheet feeder which feeds sheets at predetermined sheet intervals;

a conveyor which conveys a plurality of sheets fed by said sheet feeder;

a controller which, after temporarily discontinuing conveyance of the plurality of sheets by said conveyor, resumes conveyance of the plurality of sheets by said conveyor; and a corrector which corrects, upon resuming sheet conveyance, variations in the sheet interval caused upon temporarily discontinuing sheet conveyance.

2. A sheet conveying apparatus according to claim 1, wherein said corrector delays the resumption of conveyance of a following sheet by a time corresponding to a decrease in the sheet interval which is caused upon temporary discontinuance of sheet conveyance.

3. A sheet conveying apparatus comprising:

a feeder which feeds in sequence a first sheet, a second sheet and a third sheet at predetermined intervals;

a conveyor which conveys the first sheet, the second sheet and the third sheet fed by said feeder to a registration roller;

a controller which, after temporarily discontinuing conveyance of the first sheet, the second sheet and the third sheet by said conveyor in response to arrival of said first sheet at said registration roller, resume conveyance of the first sheet, the second sheet and the third sheet by said conveyor; and a corrector which corrects a variation in the sheet interval between the first sheet and the second sheet upon resuming conveyance of the second sheet, and corrects a variation in the sheet interval between the second sheet and the third sheet upon resuming conveyance of the third sheet.

4. A sheet conveying apparatus according to claim 3, wherein said corrector resumes conveyance of the second sheet by delaying by a first period of time corresponding to the sheet interval between the first sheet and the second sheet which is decreased upon temporary discontinuance of sheet conveyance, and resumes conveyance of the third sheet by delaying by a second period of time corresponding to the sheet interval between the second sheet and the third sheet which is decreased upon temporary discontinuance of sheet conveyance.

5. A sheet conveying apparatus comprising:

a roller which conveys sheets;

a driver which generates a driving force to drive said roller;

a clutch which transmits the driving force of said driver to said roller;

a controller which controls engagement and disengagement of said clutch; and a memory which stores data of stop characteristics of said roller upon disengagement of said clutch, wherein said controller controls reengagement timing of said clutch on the basis of the data stored in said memory, and wherein said controller delays reengagement of said clutch by a period of time corresponding to the data stored in said memory.

6. A sheet conveying apparatus according to claim 5, wherein said controller controls engagement of said clutch after disengagement of said clutch; and when the time from disengagement of said clutch to the reengagement of said clutch is shorter than the period of time corresponding to the data stored in said memory, said controller delays the reengagement of said clutch by a period of time.

7. A sheet conveying apparatus according to claim 5, wherein said data of stop characteristics of said roller stored in said memory is data corresponding to an amount of lead of a sheet conveyed by said roller upon release of said clutch.

8. A sheet conveying apparatus according to claim 5, wherein the data of stop characteristics corresponds to data stored in memory on an amount of lead of the sheet conveyed by said roller upon disengagement of said clutch based on time required for conveying a sheet from a first position to a second position without disengaging said clutch, and a time required for conveying a sheet from the first position to the second position when said clutch is reengaged after disengaging said clutch when the sheet is present between the first position and the second position.

9. A sheet conveying apparatus comprising:

first, second and third rollers which convey sheets;

a driver which generates a driving force to drive said first, second and third rollers;

first, second and third clutches which transmit the driving force of said driver respectively to said first, said second and said third rollers;

a controller which controls engagement and disengagement of said first, second and third clutches; and a memory storing first data of stop characteristics of a sheet upon disengagement of said first and said second clutches while said first and said second rollers hold the sheet in between, and storing second data of stop characteristics of the sheet upon disengagement of said second clutch and said third clutch while said second roller and said third roller hold the sheet in between;

wherein said controller controls the engagement timing of said first, said second and said third clutches on the basis of at least one of the first data and the second data stored in said memory.

10. A sheet conveying apparatus according to claim 9, wherein the first data and the second data stored in said memory comprise data of stop characteristics corresponding to an amount of lead of the sheet conveyed by said first roller and said second roller upon disengagement of said first clutch and said second clutch, and data corresponding to an amount of lead of the sheet conveyed by said second roller and said third roller upon disengagement of said second clutch and said third clutch.

11. A sheet conveying apparatus according to claim 9, wherein said controller selects one of the first data and the second data, depending upon which of said first, said second and said third rollers the sheet is held in between.

12. A sheet conveying apparatus according to claim 11, wherein said controller selects the first data when the sheet is held by said first and said second rollers, and selects the second data when the sheet is held by said second and said third rollers.

13. A sheet conveying apparatus according to claim 12, wherein said controller selects the first data if the sheet is held by said first, said second and said third rollers in between when the first data show stop characteristics for stoppage of the sheet within a shorter period of time than the second data.

14. A sheet conveying apparatus according to claim 12, wherein said controllers selects the second data if the sheet is held by said first, said second and said third rollers in between when the second data show stop characteristics for stoppage of the sheet within a shorter period of time than the first data.

15. A sheet conveying apparatus comprising:

a conveyor which conveys sheets along a conveying path;

a controller which, after temporarily discontinuing skeet conveyance during conveyance of the sheets by said conveyor, resumes sheet conveyance;

a first sensor provided on the conveying path;

a second sensor provided downstream of said first sensor on the conveying path; and a measurer which causes said conveyor to convey the sheets, causes sheet conveyance to stop when a sheet is between said first sensor and said second sensor; resumes sheet conveyance after a lapse of a predetermined period of time; and measures a first period of time from detection of an edge of the sheet by said first sensor to detection of an edge of the sheet by said second sensor.

16. A sheet conveying apparatus according to claim 15, wherein said conveyor contains a roller which conveys sheets; said first sensor is provided upstream of said roller, and said second sensor is provided downstream of said roller.

17. A sheet conveying apparatus according to claim 15, wherein said controller controls a timing for resuming conveyance in response to the result of the measurement by said measurer.

18. A sheet conveying apparatus according to claim 15, further comprising a third sensor provided downstream of said second sensor in the conveying path;

wherein said measurer causes the sheet having temporarily stopped between said first sensor and said second sensor to stop between said second sensor and said third sensor; resumes sheet conveyance after the lapse of a predetermined period of time; and measures a second period of lime from detection of an edge of the sheet by said second sensor to detection of an edge of the sheet by said third sensor.

19. A sheet conveying apparatus according to claim 18, wherein said conveyor contains a first roller and a second roller; said first sensor is provided upstream of said first roller; said second sensor is provided between said first roller and said second roller; and said third sensor is provided downstream of said second roller.

20. A sheet conveying apparatus according to claim 18, wherein said controller controls the timing for resuming conveyance in response to one of the first period of time and the second period of time.

21. A sheet conveying apparatus according to claim 15, further comprising an operator unit for entering an instruction to start a measuring mode for measuring characteristics of said conveyor during stoppage of conveyance and upon resumption of conveyance by said conveyor; wherein the measurement is started in response to input of the instruction to start said measuring mode from said operator unit.

* * * * *

UNITED STATES PATENT AND TRADEMARK OFFICE

CERTIFICATE OF CORRECTION

PATENT NO. : 6,651,980 B2
DATED : November 25, 2003
INVENTOR(S) : Keizo Isemura et al.

It is certified that error appears in the above-identified patent and that said Letters Patent is hereby corrected as shown below:

Title page,
Item [56], References Cited, FOREIGN PATENT DOCUMENTS, "05319630" should read -- 05-319630 --.

Column 8,
Line 2, "imported" should read -- imported by --.

Column 11,
Line 63, "fir" should read -- for --.

Column 15,
Line 4, "closes" should read -- closest --.

Column 20,
Line 44, "skeet" should read -- sheet --.

Signed and Sealed this

Fifteenth Day of June, 2004

JON W. DUDAS
*Acting Director of the United States Patent and Trademark Office*